US010723549B2

(12) United States Patent
Yang et al.

(10) Patent No.: US 10,723,549 B2
(45) Date of Patent: Jul. 28, 2020

(54) TRASH CANS WITH ADAPTIVE DAMPENING

(71) Applicant: simplehuman, LLC, Torrance, CA (US)

(72) Inventors: Frank Yang, Rancho Palos Verdes, CA (US); David Wolbert, Redondo Beach, CA (US); Guy Cohen, Marina Del Rey, CA (US); Phillip Yee, San Francisco, CA (US); Teddy Bryant, San Francisco, CA (US)

(73) Assignee: simplehuman, LLC, Torrance, CA (US)

( * ) Notice: Subject to any disclaimer, the term of this patent is extended or adjusted under 35 U.S.C. 154(b) by 0 days.

(21) Appl. No.: 15/809,218

(22) Filed: Nov. 10, 2017

(65) Prior Publication Data

US 2018/0305120 A1 Oct. 25, 2018

Related U.S. Application Data

(63) Continuation of application No. 15/476,285, filed on Mar. 31, 2017, now abandoned, which is a (Continued)

(51) Int. Cl.

| | |
|---|---|
| ***B65F 1/06*** | (2006.01) |
| ***B65F 1/16*** | (2006.01) |
| *B65F 1/14* | (2006.01) |

(52) U.S. Cl.

CPC ..... *B65F 1/163* (2013.01); *B65F 1/06* (2013.01); *B65F 1/1473* (2013.01); (Continued)

(58) Field of Classification Search

CPC .. B65F 1/141; B65F 1/04; B65F 1/163; B65F 1/1638

See application file for complete search history.

(56) References Cited

U.S. PATENT DOCUMENTS

| | | | |
|---|---|---|---|
| 830,182 | A | 9/1906 | Skov |
| 1,426,211 | A | 8/1922 | Pausin |

(Continued)

FOREIGN PATENT DOCUMENTS

| | | |
|---|---|---|
| AU | 622536 | 4/1992 |
| AU | 365296 | 11/2015 |

(Continued)

OTHER PUBLICATIONS

U.S. Appl. No. 29/484,903, filed Mar. 13, 2014, Yang et al.

(Continued)

*Primary Examiner* — Rina I Duda

(74) *Attorney, Agent, or Firm* — Knobbe, Martens, Olson & Bear, LLP

(57) ABSTRACT

Various trash can assemblies are disclosed. The trash can assembly can include a body and a lid that is movable between open and closed positions. The trash can assembly can be provided with a resistive load control system that controls the rate of movement of the lid from the open position toward the closed position and/or from the closed position toward the open position. The trash can assembly can be provided with an energy recapture system that translates mechanical energy into electrical energy through an electric generator. The electrical energy can be provided to other components of the trash can assembly, such as an ion generator that discharges ions into an interior of the trash can assembly to provide odor control.

20 Claims, 12 Drawing Sheets

Related U.S. Application Data continuation of application No. PCT/US2015/053037, filed on Sep. 29, 2015.

(60) Provisional application No. 62/058,520, filed on Oct. 1, 2014.

(52) U.S. Cl.
CPC ..... *B65F 1/1607* (2013.01); *B65F 1/1623* (2013.01); *B65F 2001/1661* (2013.01); *B65F 2210/129* (2013.01); *B65F 2210/168* (2013.01); *B65F 2250/111* (2013.01); *B65F 2250/112* (2013.01); *B65F 2250/114* (2013.01)

(56) References Cited

U.S. PATENT DOCUMENTS 1,461,253 A 7/1923 Owen
1,754,802 A 4/1930 Raster
1,820,555 A 8/1931 Buschman
1,891,651 A 12/1932 Padelford et al.
1,922,729 A 8/1933 Geibel
1,980,938 A 11/1934 Geibel
2,308,326 A 1/1943 Calcagno
D148,825 S 2/1948 Snider
2,457,274 A 12/1948 Rifken
2,759,625 A 8/1956 Ritter
2,796,309 A 6/1957 Taylor
2,888,307 A 5/1959 Graves et al.
2,946,474 A 7/1960 Knapp
3,008,604 A 11/1961 Garner
3,023,922 A 3/1962 Arrington et al.
3,137,408 A 6/1964 Taylor
3,300,082 A 1/1967 Patterson
3,392,825 A 7/1968 Gale et al.
3,451,453 A 6/1969 Heck
3,654,534 A 4/1972 Fischer
3,800,503 A 4/1974 Maki
3,820,200 A 6/1974 Myers
3,825,150 A 7/1974 Taylor
3,825,215 A 7/1974 Borglum
3,886,425 A * 5/1975 Weiss ..... E05F 15/63 318/267
3,888,406 A 6/1975 Nippes
3,891,115 A 6/1975 Ono
4,014,457 A 3/1977 Hodge
4,027,774 A 6/1977 Cote
4,081,105 A 3/1978 Dagonnet et al.
4,189,808 A 2/1980 Brown
4,200,197 A 4/1980 Meyer et al.
4,217,616 A 8/1980 Jessup
4,303,174 A 12/1981 Anderson
4,320,851 A 3/1982 Montoya
4,349,123 A 9/1982 Yang
4,357,740 A 11/1982 Brown
4,416,197 A 11/1983 Kehl
4,417,669 A 11/1983 Knowles et al.
4,457,483 A 7/1984 Gagne
4,535,911 A 8/1985 Goulter
4,570,304 A 2/1986 Montreuil et al.
4,576,310 A 3/1986 Isgar et al.
D284,320 S 6/1986 Kubic et al.
4,609,117 A 9/1986 Pamment
4,630,332 A 12/1986 Bisbing
4,630,752 A 12/1986 DeMars
4,664,347 A 5/1987 Brown et al.
4,697,312 A 10/1987 Freyer
4,711,161 A 12/1987 Swin et al.
4,729,490 A * 3/1988 Ziegenbein ..... B65F 1/1638 220/211
4,753,367 A 6/1988 Miller et al.
4,763,808 A 8/1988 Guhl et al.
4,765,548 A 8/1988 Sing
4,765,579 A 8/1988 Robbins, III et al.
4,785,964 A 11/1988 Miller et al.
4,792,039 A 12/1988 Dayton
4,794,973 A 1/1989 Perisic
4,813,592 A 3/1989 Stolzman
4,823,979 A 4/1989 Clark, Jr.
4,834,260 A 5/1989 Auten
4,863,053 A 9/1989 Oberg
4,867,339 A 9/1989 Hahn
4,869,391 A 9/1989 Farrington
4,884,717 A 12/1989 Bussard et al.
4,888,532 A 12/1989 Josson
4,892,223 A 1/1990 DeMent
4,892,224 A 1/1990 Graham
D307,344 S 4/1990 Massonnet
4,913,308 A 4/1990 Culbertson
4,915,347 A 4/1990 Iqbal et al.
4,918,568 A 4/1990 Stone et al.
D308,272 S 5/1990 Koepsell
4,923,087 A 5/1990 Burrows
4,944,419 A 7/1990 Chandler
4,948,004 A 8/1990 Chich
4,964,523 A 10/1990 Bieltvedt et al.
4,972,966 A 11/1990 Craft, Jr.
4,996,467 A 2/1991 Day
5,031,793 A 7/1991 Chen et al.
5,048,903 A 9/1991 Loblein
5,054,724 A 10/1991 Hutcheson
5,065,272 A 11/1991 Owen et al.
5,065,891 A 11/1991 Casey
5,076,462 A 12/1991 Perrone
D323,573 S 1/1992 Schneider
5,090,585 A 2/1992 Power
5,090,785 A 2/1992 Stamp
5,100,087 A 3/1992 Ashby
5,111,958 A 5/1992 Witthoeft
D327,760 S 7/1992 Donnelly
D329,929 S 9/1992 Knoedler et al.
5,147,055 A 9/1992 Samson et al.
5,156,290 A 10/1992 Rodrigues
D331,097 S 11/1992 Sieren
5,170,904 A 12/1992 Neuhaus
5,174,462 A 12/1992 Hames
D332,852 S 1/1993 Delmerico
D335,562 S 5/1993 Evans
5,213,272 A 5/1993 Gallagher et al.
5,222,704 A 6/1993 Light
D337,181 S 7/1993 Warman
5,226,558 A 7/1993 Whitney et al.
5,230,525 A 7/1993 Delmerico et al.
5,242,074 A 9/1993 Conaway et al.
D340,333 S 10/1993 Duran et al.
5,249,693 A 10/1993 Gillispie et al.
5,261,553 A 11/1993 Mueller et al.
5,265,511 A 11/1993 Itzov
5,295,607 A 3/1994 Chang
5,305,916 A 4/1994 Suzuki et al.
5,314,151 A 5/1994 Carter-Mann
5,322,179 A 6/1994 Ting
5,329,212 A 7/1994 Feigleson
5,348,222 A 9/1994 Patey
5,353,950 A 10/1994 Taylor et al.
5,372,272 A 12/1994 Jennings
5,381,588 A 1/1995 Nelson
5,385,258 A 1/1995 Sutherlin
5,390,818 A 2/1995 LaBuda
5,404,621 A 4/1995 Heinke
5,407,089 A 4/1995 Bird et al.
5,419,452 A 5/1995 Mueller et al.
5,471,708 A 12/1995 Lynch
5,474,201 A 12/1995 Liu
5,501,358 A 3/1996 Hobday
5,520,067 A 5/1996 Gaba
5,520,303 A 5/1996 Bernstein et al.
5,531,348 A 7/1996 Baker et al.
5,535,913 A 7/1996 Asbach et al.
5,558,254 A 9/1996 Anderson et al.
5,560,283 A 10/1996 Hannig
5,584,412 A 12/1996 Wang
D377,554 S 1/1997 Adriaansen
5,611,507 A 3/1997 Smith

(56) References Cited

U.S. PATENT DOCUMENTS 5,628,424 A 5/1997 Gola
5,632,401 A 5/1997 Hurd
5,636,416 A 6/1997 Anderson
5,636,761 A 6/1997 Diamond et al.
5,644,111 A 7/1997 Cerny et al.
5,645,186 A 7/1997 Powers et al.
5,650,680 A 7/1997 Chula
D383,277 S 9/1997 Peters
5,662,235 A 9/1997 Nieto
5,671,847 A 9/1997 Pedersen et al.
5,690,247 A 11/1997 Boover
5,695,088 A 12/1997 Kasbohm
5,699,929 A 12/1997 Ouno
D388,922 S 1/1998 Peters
D389,631 S 1/1998 Peters
5,704,511 A 1/1998 Kellams
5,724,837 A 3/1998 Shin
5,730,312 A 3/1998 Hung
5,732,845 A 3/1998 Armaly, Jr.
5,735,495 A 4/1998 Kubota
5,738,239 A 4/1998 Triglia
5,770,935 A 6/1998 Smith et al.
5,799,909 A 9/1998 Ziegler
5,816,431 A 10/1998 Giannopoulos
5,816,640 A 10/1998 Nishimura
D401,383 S 11/1998 Gish
D401,719 S 11/1998 Van Leeuwen et al.
5,873,643 A 2/1999 Burgess, Jr. et al.
5,881,896 A 3/1999 Presnell et al.
5,881,901 A 3/1999 Hampton
5,884,237 A 3/1999 Kanki et al.
5,887,748 A 3/1999 Nguyen
D412,552 S 8/1999 Burrows
5,961,105 A 10/1999 Ehrnsberger et al.
5,967,392 A 10/1999 Niemi et al.
5,987,708 A 11/1999 Newton
6,000,569 A 12/1999 Liu
6,010,024 A 1/2000 Wang
6,024,238 A 2/2000 Jaros
6,036,050 A 3/2000 Ruane
6,102,239 A 8/2000 Wien
6,105,859 A 8/2000 Stafford
6,123,215 A 9/2000 Windle
D431,700 S 10/2000 Roudebush
6,126,031 A 10/2000 Reason
6,129,233 A 10/2000 Schiller
6,131,861 A 10/2000 Fortier, Jr. et al.
D435,951 S 1/2001 Yang et al.
6,209,744 B1 4/2001 Gill
6,211,637 B1 * 4/2001 Studer ..... B65F 1/141 318/16
6,234,339 B1 5/2001 Thomas
6,250,492 B1 6/2001 Verbeek
D445,980 S 7/2001 Tjugum
6,286,706 B1 9/2001 Tucker
6,328,320 B1 12/2001 Walski et al.
6,345,725 B1 2/2002 Lin
6,364,147 B1 4/2002 Meinzinger et al.
6,386,386 B1 5/2002 George
6,390,321 B1 5/2002 Wang
6,401,958 B1 6/2002 Foss et al.
6,519,130 B1 2/2003 Breslow
6,557,716 B1 5/2003 Chan
D476,456 S 6/2003 Englert et al.
6,596,983 B2 7/2003 Brent
6,612,099 B2 * 9/2003 Stravitz ..... B65B 9/15 53/526
6,626,316 B2 9/2003 Yang
6,626,317 B2 9/2003 Pfiefer et al.
6,632,064 B1 10/2003 Walker et al.
D481,846 S 11/2003 Lin
D482,169 S 11/2003 Lin
6,659,407 B2 12/2003 Asaro
6,681,950 B2 1/2004 Miller, Jr. et al.
D488,604 S 4/2004 Yang et al.
D488,903 S 4/2004 Yang et al.
D489,503 S 5/2004 Lin
D489,857 S 5/2004 Yang et al.
D490,583 S 5/2004 Yang et al.
D490,954 S 6/2004 Brand
D491,706 S 6/2004 Yang et al.
6,758,366 B2 7/2004 Bourgund et al.
D493,930 S 8/2004 Wang
D494,723 S 8/2004 Lin
6,785,912 B1 * 9/2004 Julio ..... A47K 13/30 4/233
6,812,655 B1 11/2004 Wang et al.
6,814,249 B2 11/2004 Lin
D499,450 S 12/2004 Goodman et al.
6,837,393 B1 1/2005 Kuo
6,857,538 B2 2/2005 Lin
6,859,005 B2 2/2005 Boliver
D503,021 S 3/2005 Yang et al.
6,866,826 B2 3/2005 Moore et al.
6,883,676 B2 4/2005 Lin
D507,090 S 7/2005 Yang et al.
6,920,994 B2 7/2005 Lin
6,974,948 B1 12/2005 Brent
D513,445 S 1/2006 Lin
6,981,606 B2 1/2006 Yang et al.
D517,764 S 3/2006 Wang
D517,767 S 3/2006 Yang et al.
D518,266 S 3/2006 Yang et al.
7,017,773 B2 3/2006 Gruber et al.
7,044,323 B2 5/2006 Yang et al.
D525,756 S 7/2006 Yang et al.
7,073,677 B2 7/2006 Richardson et al.
7,077,283 B2 7/2006 Yang et al.
7,080,750 B2 7/2006 Wein et al.
7,086,550 B2 8/2006 Yang et al.
D528,726 S 9/2006 Lin
7,121,421 B2 10/2006 Yang et al.
D531,499 S 11/2006 Zaidman
D535,799 S 1/2007 Epps
D535,800 S 1/2007 Yang et al.
7,163,591 B2 1/2007 Kim et al.
7,168,591 B1 1/2007 Miller
D537,223 S 2/2007 Lin
D537,599 S 2/2007 Lin
D537,601 S 2/2007 Lin
D537,999 S 3/2007 Lin
D538,995 S 3/2007 Lin
D539,498 S 3/2007 Yang et al.
D539,499 S 3/2007 Yang et al.
D540,001 S 4/2007 Zimmerman
D542,001 S 5/2007 Yang et al.
D542,995 S 5/2007 Lin
D543,673 S 5/2007 Yang et al.
D544,170 S 6/2007 Lin
D544,171 S 6/2007 Lin
D544,671 S 6/2007 Saunders et al.
D545,024 S 6/2007 Liao
7,225,943 B2 6/2007 Yang et al.
D547,020 S 7/2007 Chen
7,243,811 B1 7/2007 Ramsey
D550,918 S 9/2007 Wang et al.
D552,319 S 10/2007 Gusdorf
D552,321 S 10/2007 Yang et al.
D552,823 S 10/2007 Yang et al.
D552,824 S 10/2007 Zimmerman
D552,825 S 10/2007 Yang et al.
D555,320 S 11/2007 Yang et al.
D559,494 S 1/2008 Yang et al.
D559,495 S 1/2008 Yang et al.
D562,522 S 2/2008 Daams
7,328,842 B2 2/2008 Wagner et al.
D564,169 S 3/2008 Wang
D564,723 S 3/2008 Yang et al.
D566,367 S 4/2008 Lin
D566,369 S 4/2008 Shek
D566,923 S 4/2008 Lin
D567,468 S 4/2008 Yang et al.
D568,572 S 5/2008 Yang et al.
D569,720 S 5/2008 Lablaine

(56) References Cited

U.S. PATENT DOCUMENTS 7,374,060 B2 5/2008 Yang et al.
D571,520 S 6/2008 Lin
7,395,990 B1 7/2008 Stevens
7,398,913 B2 7/2008 McClure
7,404,499 B1 7/2008 Ramsey
D574,569 S 8/2008 Yang et al.
D576,371 S 9/2008 Zimmerman
D578,265 S 10/2008 Presnell
D578,266 S 10/2008 Yang et al.
D578,268 S 10/2008 Yang et al.
D578,722 S 10/2008 Yang et al.
7,438,199 B1 10/2008 Tidrick
D580,120 S 11/2008 Lin
D580,613 S 11/2008 Yang et al.
D580,615 S 11/2008 Yang et al.
D581,622 S 11/2008 Presnell et al.
D584,470 S 1/2009 Bizzell et al.
D585,171 S 1/2009 Bizzell et al.
D585,618 S 1/2009 Yang et al.
D586,070 S 2/2009 Lin
7,494,021 B2 2/2009 Yang et al.
D587,874 S 3/2009 Lin
D593,271 S 5/2009 Yang et al.
7,530,578 B2 5/2009 Niemeyer et al.
7,540,396 B2 6/2009 Yang et al.
7,543,716 B2 6/2009 Lin
7,559,433 B2 7/2009 Yang et al.
D599,074 S 8/2009 Bizzell et al.
D603,119 S 10/2009 Yang et al.
7,607,552 B2 10/2009 Efstathiou
D604,472 S 11/2009 Blanks et al.
7,614,519 B2 11/2009 Krauth et al.
7,621,420 B2 11/2009 Bandoh et al.
7,656,109 B2 2/2010 Yang et al.
D611,216 S 3/2010 Yang et al.
D611,217 S 3/2010 Bizzell et al.
D611,671 S 3/2010 Yang et al.
7,694,838 B2 4/2010 Yang et al.
7,703,622 B1 4/2010 Bynoe
D615,270 S 5/2010 Yang et al.
D615,722 S 5/2010 Yang et al.
7,712,285 B2 5/2010 Stravitz et al.
7,741,801 B2 6/2010 Fukuizumi
7,748,556 B2 7/2010 Yang et al.
7,781,995 B2 * 8/2010 Yang ..... B65F 1/08 220/211
D623,817 S 9/2010 Yang et al.
D625,068 S 10/2010 Shannon
7,806,285 B2 10/2010 Yang et al.
D627,533 S 11/2010 Yang et al.
D627,944 S 11/2010 Wang et al.
D629,172 S 12/2010 Liao
D630,404 S 1/2011 Yang et al.
D631,221 S 1/2011 Yang et al.
D632,039 S 2/2011 Yang et al.
D632,864 S 2/2011 Yang et al.
D634,911 S 3/2011 Yang et al.
D635,319 S 3/2011 Meyerhoffer
7,896,187 B2 3/2011 Haibel
7,922,024 B2 4/2011 Yang et al.
7,950,543 B2 5/2011 Yang et al.
D644,390 S 8/2011 Smeets et al.
7,992,742 B1 8/2011 Kim
8,006,857 B2 8/2011 Lin
D644,806 S 9/2011 Yang et al.
D644,807 S 9/2011 Yang et al.
D649,728 S 11/2011 Campbell
8,074,833 B2 12/2011 Yang et al.
8,096,445 B2 1/2012 Yang et al.
D655,061 S 2/2012 Scaturro
8,136,688 B2 3/2012 Lee et al.
D657,108 S 4/2012 Yang et al.
D657,109 S 4/2012 Liao
8,297,470 B2 10/2012 Yang et al.
8,317,055 B2 11/2012 Zawrotny et al.
D672,520 S 12/2012 Yang et al.
D673,750 S 1/2013 Quan
D675,802 S 2/2013 Yang et al.
D675,803 S 2/2013 Yang et al.
8,393,489 B1 * 3/2013 Stravitz ..... B65F 1/1623 220/263
8,418,869 B2 4/2013 Yang et al.
D689,255 S 9/2013 Sun Ting Kung et al.
8,567,630 B2 10/2013 Yang et al.
8,569,980 B2 * 10/2013 Yang ..... B65F 1/1638 220/200
8,575,537 B2 11/2013 Yao et al.
8,672,171 B2 3/2014 Wynn et al.
8,678,219 B1 * 3/2014 Wang ..... B65F 1/163 220/211
8,686,676 B2 * 4/2014 Yang ..... B65F 1/1638 318/466
D704,406 S 5/2014 Kern
8,716,969 B2 5/2014 Yang et al.
8,720,728 B2 5/2014 Yang et al.
D709,662 S 7/2014 Yang et al.
8,766,582 B2 7/2014 Yang et al.
8,807,378 B2 8/2014 Kaberna
8,807,379 B1 8/2014 Hammond
D714,510 S 9/2014 Yang et al.
D715,575 S 10/2014 Williams et al.
D716,015 S 10/2014 van de Leest
8,851,316 B2 10/2014 Barrett et al.
8,872,459 B2 * 10/2014 Yang ..... B65F 1/02 318/436
D725,860 S 3/2015 Spivey et al.
D725,861 S 3/2015 Yang et al.
D730,008 S 5/2015 Yang et al.
9,051,093 B2 6/2015 Yang et al.
D755,461 S 5/2016 Wall
D758,686 S 6/2016 Beumer
D759,934 S 6/2016 Yang et al.
D762,037 S 7/2016 Chen
D765,937 S 9/2016 Chen
D766,998 S 9/2016 Kao et al.
9,434,538 B2 9/2016 Yang et al.
D770,121 S 10/2016 Chen
D771,344 S 11/2016 Yang et al.
D773,145 S 11/2016 Yang et al.
9,481,515 B2 11/2016 Yang et al.
D773,769 S 12/2016 Chen
9,573,759 B2 2/2017 Yang et al.
9,586,755 B1 3/2017 Yang et al.
D787,828 S 5/2017 Thoma et al.
D790,145 S 6/2017 Chen
D793,642 S 8/2017 Yang et al.
D798,016 S 9/2017 Yang et al.
9,751,692 B2 9/2017 Yang et al.
9,790,025 B2 10/2017 Yang et al.
D804,133 S 11/2017 Yang et al.
9,856,080 B2 1/2018 Yang et al.
D820,544 S 6/2018 Joseph
D825,876 S 8/2018 Chen
D829,400 S 9/2018 Yang et al.
D830,029 S 10/2018 Greenspoon et al.
D835,374 S 12/2018 Yang et al.
D835,376 S 12/2018 Yang et al.
10,279,996 B2 5/2019 Yang et al.
10,279,997 B2 5/2019 Yang et al.
D855,919 S 8/2019 Yang et al.
D858,024 S 8/2019 Yang et al.
D858,923 S 9/2019 Yang et al.
10,472,170 B2 11/2019 Yang et al.
10,494,175 B2 12/2019 Yang et al.
2001/0002690 A1 6/2001 Rosky
2001/0020619 A1 9/2001 Pfeifer et al.
2001/0045512 A1 11/2001 Brent
2002/0066736 A1 6/2002 Pyles
2002/0092853 A1 7/2002 Wang
2002/0096523 A1 7/2002 Pyles
2002/0096524 A1 7/2002 Hardesty
2002/0100758 A1 8/2002 Pyles
2002/0104266 A1 8/2002 Ranaudo
2002/0116924 A1 8/2002 Winkelmann et al.

(56) References Cited

U.S. PATENT DOCUMENTS

2003/0089719 A1 5/2003 Berger
2003/0102316 A1 6/2003 Forest
2003/0201265 A1 10/2003 Lin
2003/0205979 A1 11/2003 Papari et al.
2003/0230576 A1 12/2003 Lin
2004/0016756 A1 1/2004 Lin
2004/0028572 A1* 2/2004 Sham ..... A61L 2/202 422/123
2004/0134924 A1 7/2004 Hansen et al.
2004/0140782 A1 7/2004 Okabe et al.
2004/0164077 A1 8/2004 Kuo
2004/0174268 A1 9/2004 Scott et al.
2004/0175303 A1 9/2004 Lin
2004/0199401 A1 10/2004 Wagner
2004/0200938 A1 10/2004 Forlivio
2004/0206758 A1 10/2004 Lin
2004/0206760 A1 10/2004 Gagnebin
2004/0250711 A1 12/2004 Ernst
2004/0251746 A1 12/2004 Ichimaru et al.
2005/0017006 A1 1/2005 Kuo
2005/0017010 A1 1/2005 Siegel et al.
2005/0029281 A1 2/2005 Westermann et al.
2005/0129803 A1 6/2005 Umeda et al.
2005/0258177 A1 11/2005 Woodson
2005/0258794 A1 11/2005 Fukuizumi
2006/0027579 A1 2/2006 Yang et al.
2006/0103086 A1 5/2006 Niemeyer et al.
2006/0138149 A1 6/2006 Tracy
2006/0163257 A1 7/2006 Golbert
2006/0175336 A1 8/2006 Wang
2006/0186121 A1 8/2006 Yang et al.
2006/0196874 A1 9/2006 Yang
2006/0237641 A1 10/2006 Moeller et al.
2006/0249510 A1 11/2006 Lin
2006/0278643 A1 12/2006 Chiou
2007/0012699 A1 1/2007 Yang et al.
2007/0034334 A1 2/2007 Ramsey et al.
2007/0045326 A1 3/2007 Tramontina et al.
2007/0090112 A1 4/2007 Kalman et al.
2007/0114847 A1 5/2007 Ichimaru et al.
2007/0181579 A1 8/2007 Kuo et al.
2007/0209846 A1 9/2007 Wilson
2007/0215622 A1 9/2007 Perez
2007/0241109 A1 10/2007 Lin
2007/0266637 A1 11/2007 McGowan
2007/0272691 A1 11/2007 Wang et al.
2007/0289972 A1 12/2007 Wynn et al.
2008/0011754 A1 1/2008 Ramsey
2008/0011910 A1 1/2008 Ramsey
2008/0041863 A1 2/2008 Forest
2008/0083756 A1 4/2008 Daniels
2008/0083757 A1 4/2008 Parker et al.
2008/0099274 A1 5/2008 Seel
2008/0128428 A1 6/2008 Beckerman
2008/0164257 A1 7/2008 Boll et al.
2008/0236275 A1 10/2008 Breed et al.
2008/0257889 A1 10/2008 Kovacevich et al.
2008/0257890 A1 10/2008 Kovacevich et al.
2008/0257891 A1 10/2008 Kovacevich et al.
2008/0264948 A1 10/2008 Kovacevich et al.
2008/0264950 A1 10/2008 Kovacevich et al.
2008/0272119 A1 11/2008 Efstathiou
2008/0272127 A1 11/2008 Kovacevich et al.
2009/0071959 A1 3/2009 Cheung
2009/0084788 A1 4/2009 Yang et al.
2009/0136341 A1 5/2009 Kenyon
2009/0230131 A1 9/2009 McDuffie et al.
2009/0261105 A1 10/2009 Cunningham et al.
2009/0266836 A1 10/2009 Mobley
2010/0006572 A1 1/2010 Chiou
2010/0084235 A1 4/2010 Lu
2010/0096894 A1 4/2010 Fukai
2010/0122985 A1 5/2010 Peters et al.
2010/0147865 A1 6/2010 Yang et al.
2010/0170904 A1 7/2010 Kalman et al.
2010/0178105 A1 7/2010 Monneret
2010/0193518 A1 8/2010 Tontarelli
2010/0237074 A1 9/2010 Yang et al.
2010/0252557 A1 10/2010 Clements
2010/0294769 A1 11/2010 Lee et al.
2011/0017735 A1 1/2011 Wang et al.
2011/0049149 A1 3/2011 Shih
2011/0056952 A1 3/2011 Borowski et al.
2011/0139781 A1 6/2011 Jin et al.
2011/0272409 A1 11/2011 Kasbohm
2012/0145932 A1 6/2012 Yao et al.
2012/0234849 A1 9/2012 Hughes et al.
2012/0261423 A1 10/2012 Zawrotny et al.
2013/0048641 A1 2/2013 Romano
2013/0097809 A1 4/2013 Weber et al.
2013/0098913 A1 4/2013 Yang et al.
2013/0105487 A1 5/2013 Baik
2013/0233857 A1* 9/2013 Yang ..... B65F 1/04 220/495.08
2013/0240592 A1 9/2013 Woodruff
2013/0248535 A1 9/2013 Wolfe et al.
2013/0300119 A1 11/2013 Anzalon et al.
2014/0183193 A1 7/2014 Hammond et al.
2014/0238989 A1 8/2014 Wang et al.
2014/0305946 A1 10/2014 Han
2014/0345453 A1 11/2014 Oh et al.
2015/0251849 A1 9/2015 Yang et al.
2015/0259139 A1 9/2015 Yang et al.
2015/0321841 A1 11/2015 Salas et al.
2016/0200508 A1 7/2016 Thoma et al.
2017/0050404 A1 2/2017 Henken et al.
2017/0127669 A1 5/2017 Yang et al.
2017/0166167 A1 6/2017 Heller et al.
2017/0253429 A1 9/2017 Yang et al.
2018/0093827 A1 4/2018 Yang et al.
2018/0178978 A1 6/2018 Yang et al.
2019/0077595 A1 3/2019 Wang et al.
2019/0185263 A1 6/2019 Yang et al.
2019/0276232 A1 9/2019 Yang et al.

FOREIGN PATENT DOCUMENTS

AU 201614908 11/2016
AU 201614909 11/2016
CA 2182840 9/1997
CA 2519295 3/2007
CA 132181 6/2010
CA 2695086 9/2010
CA 136938 5/2011
CA 141819 4/2012
CA 146601 2/2013
CA 152797 4/2014
CA 158595 4/2015
CA 158685 4/2015
CA 164264 10/2016
CA 164265 10/2016
CA 167073 10/2016
CA 170360 3/2017
CA 170399 3/2017
CA 168936 10/2017
CA 174731 7/2018
CA 178712 11/2018
CN 2075182 U 4/1991
CN 101177946 A 5/2008
CN 201105898 Y 8/2008
CN 201372076 Y 12/2009
CN 201447201 U 5/2010
CN 201512253 U 6/2010
CN 301252792 S 6/2010
CN 201597962 U 10/2010
CN 301947175 S 6/2012
CN 103207416 A 7/2013
CN 103300590 A 9/2013
CN 103303618 A 9/2013
CN 302771721 S 3/2014
CN ZL 201410074431.2 3/2014
CN 104016030 A 9/2014
CN 303188855 S 4/2015
CN 303206241 S 5/2015

(56) References Cited

FOREIGN PATENT DOCUMENTS

| | | | |
|---|---|---|---|
| CN | 105015986 | A | 11/2015 |
| CN | 303611394 | S | 3/2016 |
| CN | 303622098 | S | 3/2016 |
| CN | 205169479 | U | 4/2016 |
| CN | 106103299 | A | 11/2016 |
| CN | 303967208 | S | 12/2016 |
| CN | 304018339 | S | 1/2017 |
| CN | 304018340 | S | 1/2017 |
| CN | 103381944 | B | 3/2017 |
| CN | ZL 201310076306.0 | | 12/2017 |
| CN | ZL 201580000648.1 | | 1/2018 |
| CN | ZL 201730168630.4 | | 2/2018 |
| DE | 1610087 | | 7/1950 |
| DE | 822376 | | 11/1951 |
| DE | 1283741 | | 7/1966 |
| DE | 8436939 | | 3/1985 |
| DE | 9108341 | | 10/1991 |
| DE | 4225936 | | 2/1994 |
| DE | 19525885 | | 3/1997 |
| DE | 19617823 | | 11/1997 |
| DE | 19809331 | | 5/1999 |
| DE | 29918687 | | 3/2000 |
| DE | 19933180 | | 1/2001 |
| DE | 10148997 | | 4/2003 |
| DE | 20217561 | | 3/2004 |
| DE | 10337806 | A1 | 3/2005 |
| EP | 0582240 | | 7/1993 |
| EP | 0903305 | A1 | 3/1999 |
| EP | 0906876 | A2 | 4/1999 |
| EP | 1094017 | A1 | 4/2001 |
| EP | 1361176 | A1 | 11/2003 |
| EP | 1136393 | B1 | 4/2004 |
| EP | 1447342 | A2 | 8/2004 |
| EP | 1600373 | A2 | 11/2005 |
| EP | 1647503 | A1 | 4/2006 |
| EP | 1686073 | A1 | 8/2006 |
| EP | 1918223 | A1 | 5/2008 |
| EP | 1700799 | B1 | 8/2009 |
| EP | 001164826-0001 | | 9/2009 |
| EP | 001232904-0001 | | 10/2010 |
| EP | 2343250 | A1 | 7/2011 |
| EP | 001908575-0001 | | 8/2011 |
| EP | 001317416-0001 | | 4/2012 |
| EP | 001317416-0002 | | 4/2012 |
| EP | 001335285-0001 | | 7/2012 |
| EP | 001335293-0001 | | 7/2012 |
| EP | 001381636-001 | | 8/2013 |
| EP | 001381792-0001 | | 8/2013 |
| EP | 2636611 | A1 | 9/2013 |
| EP | 3144251 | A1 | 3/2014 |
| EP | 001420590-0001 | | 9/2014 |
| EP | 2772454 | A2 | 9/2014 |
| EP | 2636613 | B1 | 3/2015 |
| EP | 2915763 | A1 | 9/2015 |
| EP | 2918518 | A2 | 9/2015 |
| EP | 002766782-0001 | | 11/2015 |
| EP | 002766782-0002 | | 11/2015 |
| EP | 002766881-0001 | | 11/2015 |
| EP | 2364932 | B1 | 4/2016 |
| EP | 3042864 | A1 | 7/2016 |
| EP | 003177500-0001 | | 9/2016 |
| EP | 003177500-0002 | | 9/2016 |
| EP | 003362235-0001 | | 10/2016 |
| EP | 003362052-0001 | | 11/2016 |
| EP | 003996339-0001 | | 5/2017 |
| EP | 003996339-0002 | | 5/2017 |
| EP | 3214019 | A1 | 9/2017 |
| EP | 004554889-0001 | | 12/2017 |
| FR | 2887152 | | 12/2006 |
| GB | 191004921 | | 6/1910 |
| GB | 1555543 | A | 11/1979 |
| GB | 2384418 | | 7/2003 |
| JP | 02-152670 | | 6/1990 |
| JP | H06-56011 | | 8/1994 |
| JP | 06-272888 | | 9/1994 |
| JP | 2004-106713 | | 4/2004 |
| JP | 2004-231237 | | 8/2004 |
| JP | D1300450 | | 5/2007 |
| JP | D1300451 | | 5/2007 |
| JP | D1322056 | | 2/2008 |
| JP | D1398668 | | 10/2010 |
| JP | D1550907 | | 4/2016 |
| JP | D1551184 | | 4/2016 |
| JP | 1585339 | | 8/2017 |
| JP | 1614455 | | 8/2018 |
| KR | 3003841370000 | | 6/2005 |
| KR | 3004095430000 | | 3/2006 |
| KR | 3004095430001 | | 7/2006 |
| NL | 6908550 | | 12/1970 |
| TW | 183920 | | 5/1992 |
| TW | 230977 | | 9/1994 |
| TW | 395392 | | 6/2000 |
| TW | D112733 | | 9/2006 |
| TW | D129485 | | 7/2009 |
| TW | D133382 | | 2/2010 |
| TW | D133678 | | 3/2010 |
| TW | 145989 | | 3/2012 |
| TW | D147147 | | 5/2012 |
| TW | D154797 | | 7/2013 |
| TW | D158187 | | 1/2014 |
| TW | D161587 | | 7/2014 |
| TW | D162495 | | 8/2014 |
| TW | D168957 | | 7/2015 |
| TW | D170334 | | 9/2015 |
| TW | 201538406 | | 10/2015 |
| TW | D176312 | | 6/2016 |
| TW | D176313 | | 6/2016 |
| TW | D183552 | | 6/2017 |
| TW | D184449 | | 7/2017 |
| TW | D193369 | | 10/2018 |
| TW | D194575 | | 12/2018 |
| TW | D194576 | | 12/2018 |
| WO | WO 92/02430 | A1 | 2/1992 |
| WO | WO 96/33671 | | 10/1996 |
| WO | WO 2005/080232 | A1 | 9/2005 |
| WO | WO 2006/079263 | A1 | 8/2006 |
| WO | WO 2007/139570 | | 12/2007 |
| WO | WO 2009/114495 | A1 | 9/2009 |
| WO | WO 2015/134902 | A1 | 9/2015 |
| WO | WO 2015/138625 | A1 | 9/2015 |
| WO | WO 2016/054109 | A1 | 4/2016 |

OTHER PUBLICATIONS

U.S. Appl. No. 29/584,385, filed Nov. 14, 2016, Yang et al.
U.S. Appl. No. 15/476,285, filed Mar. 31, 2017, Yang et al.
U.S. Appl. No. 29/583,627, filed Jun. 22, 2017, Yang et al.
U.S. Appl. No. 29/608,587, filed Jun. 22, 2017, Yang et al.
U.S. Appl. No. 29/610,345, filed Jul. 11, 2017, Yang et al.
U.S. Appl. No. 29/633,369, filed Jan. 12, 2018, Yang et al.
U.S. Appl. No. 29/633,372, filed Jan. 12, 2018, Yang et al.
Trento Corner 23 Trash Can, Hailo product webpage, May 2008, http://www.hailo.de/html/default.asp?site=12_71_107&lang=en.
Simplehuman Liner Rim Dual Bucket Rectangular Recycler with Liner Pocket, Stainless Steel, 58 Liter / 15 Gallon, Item No. CW2025, www.Amazon.com, site visited Dec. 29, 2015.
Web page showing picture of Hero Bullet trash can, archived Nov. 17, 2004, downloaded from http://web.archive.org/web/20041117003115/http://www.simplehuman.com/images/hero_bullet.jpg.
International Search Report and Written Opinion in corresponding International Application No. PCT/US2015/053037, dated Feb. 5, 2016, in 12 pages.
International Preliminary Report on Patentability in corresponding International Application No. PCT/US2015/053037, dated Apr. 13, 2017, in 9 pages.

* cited by examiner

TRASH CANS WITH ADAPTIVE DAMPENING

RELATED APPLICATION

This application is a continuation of U.S. patent application Ser. No. 15/476,285, filed Mar. 31, 2017, titled "TRASH CANS WITH ADAPTIVE DAMPENING," which claims the benefit under 35 U.S.C. §§ 120 and 365(c) as a continuation of International Application No. PCT/US2015/053037, designating the U.S., with an international filing date of Sep. 29, 2015, titled "TRASH CANS," which claims the priority benefit of U.S. Provisional Patent Application No. 62/058,520, filed on Oct. 1, 2014, titled "TRASH CANS," the entire contents of which are hereby incorporated by reference herein.

BACKGROUND

Field

The present disclosure is generally related to containers, such as trash can assemblies.

Description of the Related Art

Receptacles and other devices having lids or doors are used in a variety of different settings, such as for containing refuse or for storing items such as recyclables, dirty laundry, pet food, etc. For example, in both residential and commercial settings, trash cans and other receptacles often have lids or doors for preventing the escape of the contents from the receptacle. Some trash cans include lids or doors to prevent odors from escaping and to hide the trash within the receptacle from view. Additionally, the lid of a trash can helps prevent contamination from escaping from the receptacle.

Some trash cans have fluid dampers connected to the lid to slow the closing motion of the lids. These types of trash cans typically include a foot pedal that is connected to the lid for moving the lid toward an open position. The fluid damper is connected to an internal linkage connecting the foot pedal to the lid so as to slow the closing movement of the lid, thereby preventing a loud slamming noise when the lid is moved to a closing position.

SUMMARY

Fluid dampers are acceptable for some uses and less desirable in other uses. Fluid dampers typically include a seal or gasket that can be prone to leak after extensive use. Further, to provide adequate dampening, the size of the fluid damper may need to be fairly large, thereby taking-up valuable space inside the trash can or increasing the external size of the trash can. Moreover, fluid dampers are typically not adjustable, or at least are not readily adjustable, such as during movement of the lid. Accordingly, it can be beneficial to control the motion of the lid without using, or at least without requiring, a fluid damper.

Further, certain trash cans only dampen movement of the lid as the lid closes. This can permit the lid to be opened with excessive speed, which can cause the lid to move beyond an intended fully open position and/or can overstress parts of the trash can, such as a hinge. Moreover, such excessive opening speed can allow the lid to impact a surface, such as a wall, adjacent the trash can, which can cause damage to the lid and/or the surface as well as undesirable noise. Thus, it can be beneficial to control the speed of the lid during both the opening and closing phases. In various embodiments, it can also be desirable to vary the speed of the lid during the opening and/or closing operations. For example, the lid can be moved rapidly in certain portions of the travel (e.g., initially) and less rapidly during other portions of the travel (e.g., as the lid approaches the fully open or fully closed position). This can reduce the total amount of time to open or close the lid, such as compared to an instance in which the lid is moved at a generally constant intermediate speed throughout the entire travel.

Typically, the lid of a trash can is opened by applying mechanical force, such as by a user pressing the foot pedal to raise the lid. This imbues the lid with an amount of potential energy. When the lid is closed, it is allowed to be pulled downward by gravity, thereby converting the potential energy to kinetic energy. In certain trash cans, the potential kinetic energy is converted to thermal and vibration energy, such as when the lid impacts the trash can body, thereby wasting much of the energy that was input to open the lid. Accordingly, it can be helpful to recapture some of the energy of the lid as the lid is moving, such as when the lid is closing. This can reduce the speed of the lid, which can aid in controlling the speed of the lid. Moreover, recapturing the energy can allow the energy to be stored and/or put to useful purposes, such as powering other components of the trash can.

Some trash cans discharge trash odors as the lid opens or closes, even if such trash cans include air filtration devices. Air filtration devices in such trash cans are typically passive devices that depend on odor molecules moving into contact with the filter. Thus, it can be beneficial to provide an active odor control system, such as a system that moves odor control elements generally toward odor molecules, rather than depending upon the odor molecules moving toward the odor control elements. For example, active odor control can be accomplished with a system that emits odor-reducing ionized particles into the interior space of the trash can so that the particles can interact with odor molecules. This can increase the effectiveness of the odor controlling functionality. Also, it can be beneficial for the system to inhibit the odor molecules from moving upwardly, such as out of an upper opening of the trash can. For example, the system can make at least some portion of the odor molecules heavier, so that gravity acts to inhibit such molecules from moving upwardly. This can inhibit or prevent odors from escaping from the trash can.

Several illustrative embodiments are disclosed in this specification. Any feature, structure, or step disclosed in connection with any embodiment can be replaced with or combined with any other feature, structure, or step disclosed in connection with any other embodiment, or omitted. Further, for purposes of summarizing the disclosure, certain aspects, advantages, and features of the inventions have been described herein. However, not all embodiments include or achieve any or all of those aspects, advantages, and features. No individual aspects of this disclosure are essential or indispensable.

BRIEF DESCRIPTION OF THE DRAWINGS

Various embodiments are depicted in the accompanying drawings for illustrative purposes, and should in no way be interpreted as limiting the scope of the embodiments. Furthermore, any features, structures, components, materials, and/or steps of different disclosed embodiments can be combined to form additional embodiments, which are part of this disclosure.

DETAILED DESCRIPTION

Various embodiments of containers, such as trash cans, are disclosed. The inventions disclosed herein are described in the context of trash cans (also called trash cans, garbage bins, refuse containers, or otherwise) because they have particular utility in this context. However, the inventions disclosed herein can be used in other contexts as well, such as in any other type of container. Further, although the features described herein refer to various example embodiments and drawings, variations and improvements may be accomplished in view of these teachings without deviating from the scope and spirit of the invention. By way of illustration, the many features are described in reference to a step-actuated trash container. Many other types of trash containers, such as those with side-pivoting lids or removable lids, can be used as well. Moreover, the features are not limited to domestic trash cans, but rather can be used in connection with a variety of containers as well. The embodiments and/or components thereof can be implemented in powered or manually operated systems.

I. Overview

Figure 1:
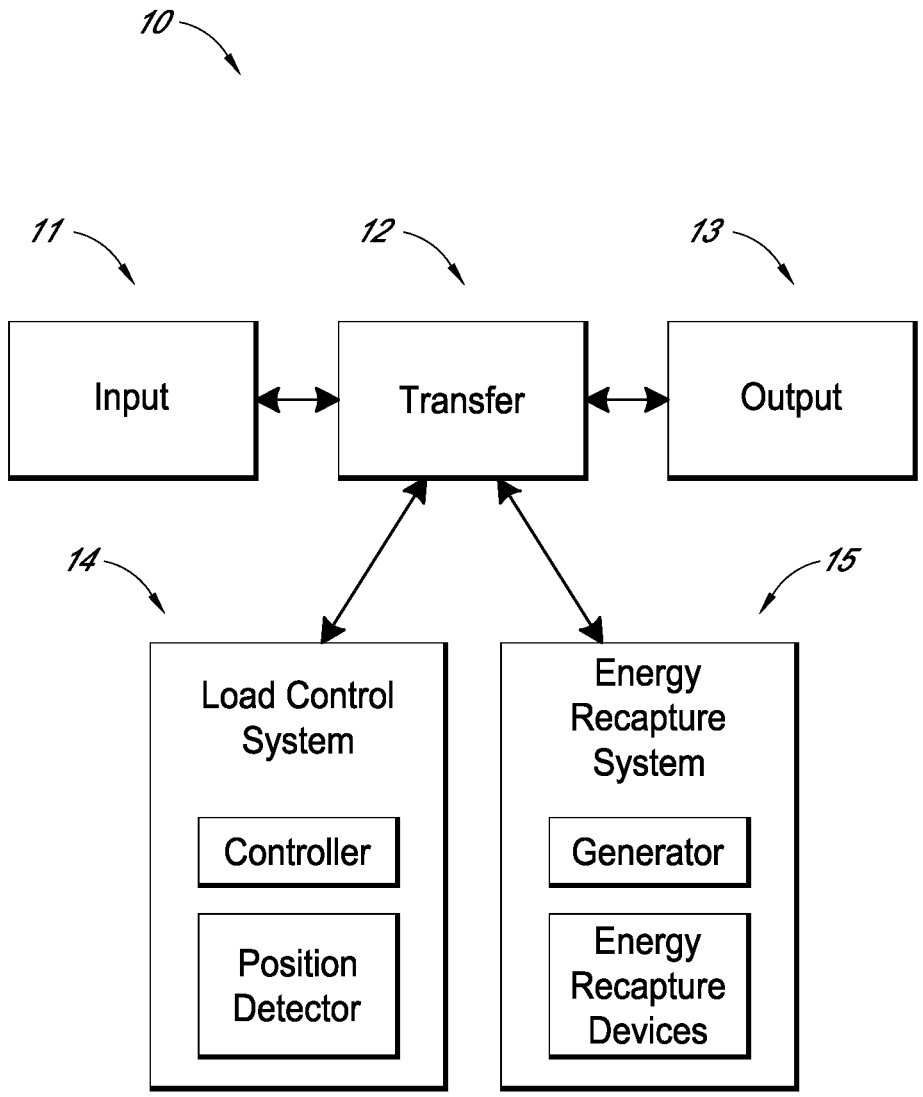
FIG. 1 schematically illustrates a trash can assembly with a load control system and/or an energy recapture system.

FIG. 1 schematically illustrates some components of a container assembly, such as a trash can assembly 10. In some embodiments, one or more of the components illustrated in FIG. 1 are not utilized. As shown, the assembly 10 can include an input 11, such as a pedal, bar, or other movable member. The input connects with a transfer 12, such as a linkage and/or gear train, that transfers motion from the input 11 to an output 13, such as a lid. As described in more detail below, in some embodiments, the transfer 12 can also connect with one or both of a load control system 14 and an energy recapture system 15. In various embodiments, the load control system 14 controls the amount of force required to move the output. As shown, the system 14 can include a controller and a position sensor, such as a lid position sensor. In various embodiments, the energy recapture system 15 can recapture a portion of the kinetic energy of the input and/or the output. As shown, the system 15 can include a generator and one or more energy storage devices.

FIGS. 2-5 illustrate an example of the trash can assembly 10. The trash can assembly 10 can include a body portion 22 with an interior space for containing material, such as refuse, recyclables, etc. A lid portion 24 is configured to move between opened and closed positions relative to the body 22 to allow the interior space to be selectively accessible (e.g., to add or remove material) or closed (e.g., to obscure the contents and/or to inhibit odors from escaping). The trash can assembly 10 can rest on a floor and can be of varying heights and widths depending on, among other things, consumer need, cost, and ease of manufacture.

The trash can assembly 10 can receive a bag liner (not shown), which can be retained at least partially within the body portion 22. For example, an upper peripheral edge of the body portion 22 can support an upper portion of the bag liner such that the bag liner is suspended and/or restrained within the body portion 22. In some embodiments, the upper edge of the body portion 22 can be rolled, include an annular lip, or otherwise include features that have a generally rounded cross-section and/or extend outwardly from a generally vertical wall of the body portion 22. The outward-extending, upper peripheral edge can support the bag liner and prevent the bag liner from tearing near an upper portion of the bag liner. Although not shown, in some embodiments, the trash can assembly 10 can include a liner support member supported by the body portion 22, which can support the bag liner.

FIGS. 2-5 illustrate the body portion 22 having a generally rectangular configuration with a rear wall 28, front wall 29, left side wall 30, and right side wall 31. However, other configurations can also be used, for example, a curved or semi-curved configuration. The body portion 22 can be made from plastic, metal (e.g., steel, stainless steel, aluminum), or any other material. In some embodiments, the rear wall 28 may include one or more apertures **28*a* configured to allow a portion of a lid actuating assembly 60** to extend therethrough, as is described in greater detail below.

The lid 24 can be moveably mounted to the body portion 22, such as with a hinge that can allow pivoting motion of the lid 24, or with other devices providing different movements. The connection between the lid 24 and the body portion 22 can be constructed so as to connect the lid 24 to an upper support member 38 or directly to the body portion 22. In some embodiments, the lid couples with, and/or is received at least partially in, an upper support member 38 (such as a "trim ring").

The trash can assembly 10 can include a base portion 44. The base portion 44 can have a generally annular and curved skirt upper portion and a generally flat lower portion for resting on a surface, such as a kitchen floor. In some implementations, the base portion 44 can include plastic, metal (e.g., steel, stainless steel, aluminum, etc.) or any other material. In some implementations, the base portion 44 and the body portion 22 can be constructed from different materials. For example, the body portion 22 can be constructed from metal (e.g., stainless steel), and the base portion 44 can be constructed from a plastic material. The base portion 44 can be separately formed with, or separately from, the body portion 22. The base portion 44 can be connected with, or attached directly to, the body portion 22, such as with adhesive, welding, and/or connection components, such as hooks and/or fasteners (e.g., screws). For example, the base portion 44 can include hooked tabs that can connect with a lower edge (e.g., a rolled edge) of the body portion 22. The hooked tabs can engage the lower edge of the body portion 22 by a snap-fit connection. In some embodiments, the base portion 44 can include projections in the form of wheels, casters, gliders, and/or other extensions that together support the trash can assembly 10 in a stable and upright position on a surface, such as flooring material surfaces such as vinyl flooring, wood flooring, carpeting, etc. The projections may provide a greater coefficient of friction with the typical flooring materials than the material of the base portion 44.

The base portion 44 (and/or other portions of the trash can assembly 10, such as the rear wall 28) can provide a mounting arrangement for a pedal 32. The pedal 32 can be connected with the lid 24 such that the lid 24 moves from the closed to open positions when the pedal 32 is moved (e.g., depressed). For example, the pedal 32 can be connected with the lid 24 via a linkage, as described in greater detail below. Typically, depressing the pedal 32 opens the lid, and releasing the pedal 32 allows the lid to begin closing. In the embodiment illustrated, the trash can assembly 10 includes a single pedal 32. Certain embodiments have a plurality of pedals, such as two, three, four, or more. In some implementations, a first pedal opens the lid and a second pedal closes the lid.

Figure 2:
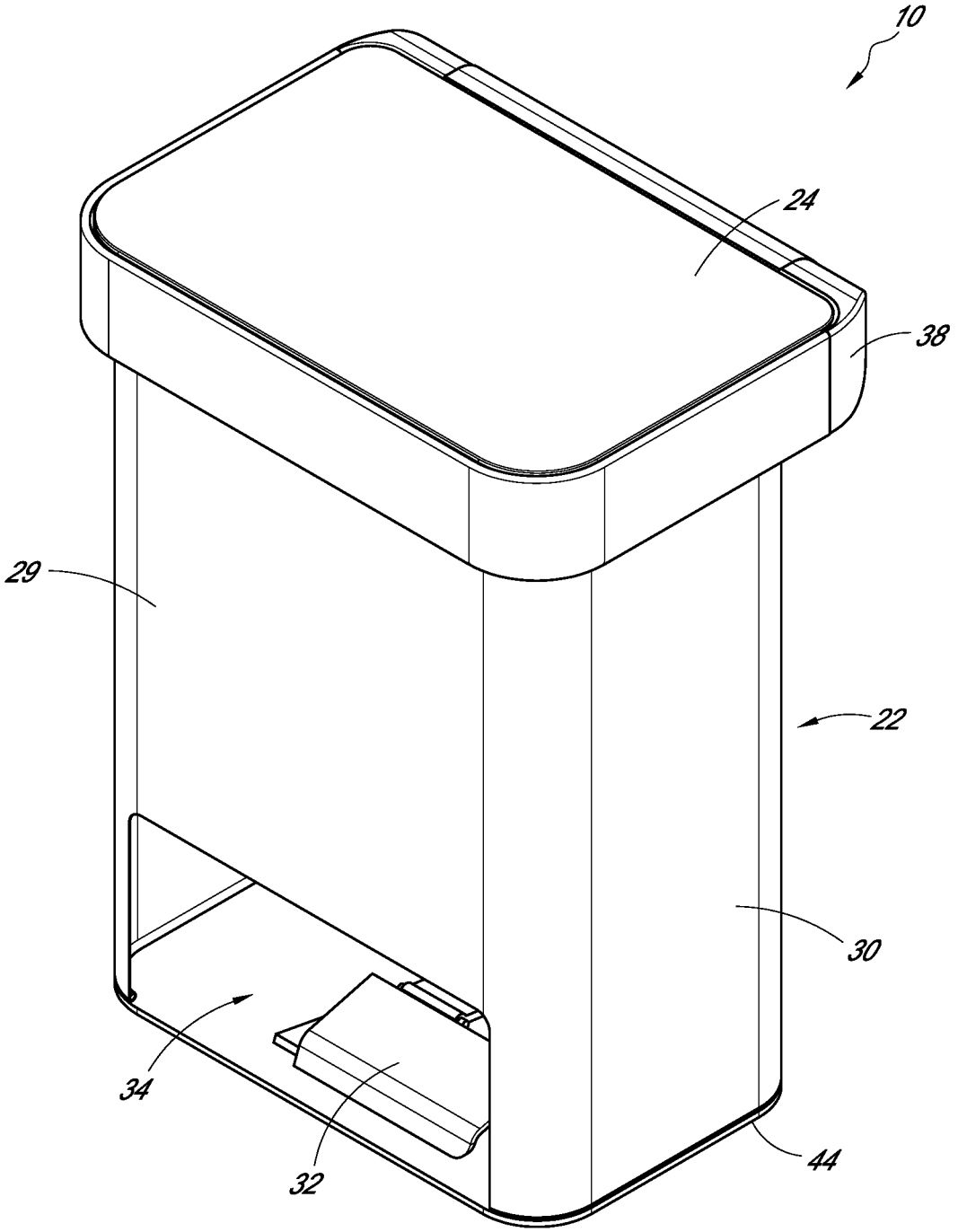
FIG. 2 illustrates a front perspective view of an embodiment of a trash can assembly.
Figure 3:
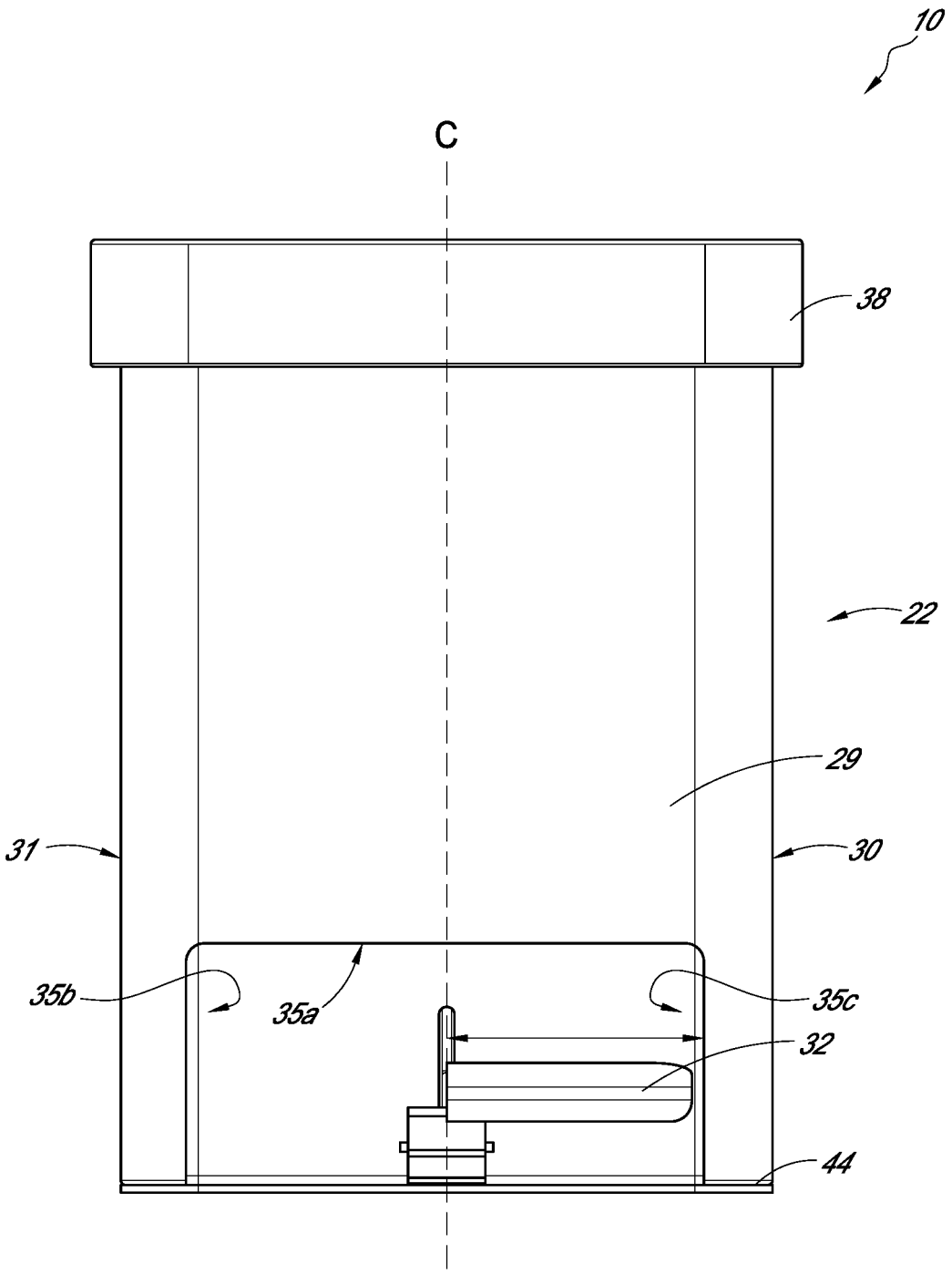
FIG. 3 illustrates a front elevation view of the trash can assembly shown in FIG. 2.

As shown in FIGS. 2 and 3, the pedal 32 can be positioned partly or completely in a recess 34. This can reduce the footprint and/or increase the stability of the trash can assembly 10. In some embodiments, at least a portion of the recess 34 is formed by (e.g., bounded or delineated by) the body portion 22 and/or the base portion 44. A portion of the recess can be bounded by one or more shoulders. For example, an entrance to the recess can be bounded by a top shoulder 35, right shoulder 35*b*, and left shoulder 35*c*.

As also shown in FIGS. 2 and 3, the pedal 32 can be offset from a lateral (also called side-to-side) centerline C of the body portion 22. For example, a lateral midpoint of the pedal 32 can be spaced apart from the lateral centerline C. In some embodiments, the lateral midpoint of the pedal 32 is near or on the lateral centerline C.

In certain implementations, the pedal 32 extends laterally, such as generally toward one or both of the sides 30, 31. As illustrated, some embodiments have a distance D from the lateral centerline to the left shoulder 35*c*. In some implementations, the pedal 32 has a lateral width that is a percentage of the distance D, such as at least about: 50%, 60%, 70%, 80% 90%, 95%, 99%, 180%, 190%, 195%, values between the aforementioned values, and other values.

As noted above, in some embodiments, the trash can assembly 10 can include a liner insert positioned within the body portion 22. The liner insert can be secured to the base portion 44. For example, the liner insert can have support members that are joined with the base portion 44 (e.g., with fasteners, welding, etc.). The support members can support and/or elevate the liner insert away from the base portion 44. The liner insert can generally support and/or cradle a lower portion of a liner disposed in the trash can assembly 10 to protect a bag liner from rupture or damage and retain spills. For instance, the liner insert can have a generally smooth surface to reduce the likelihood of the bag liner being torn or punctured by contact with the liner insert. The liner insert can form a seal (e.g., generally liquid resistant) with a lower portion of the body portion 22.

Figure 4:
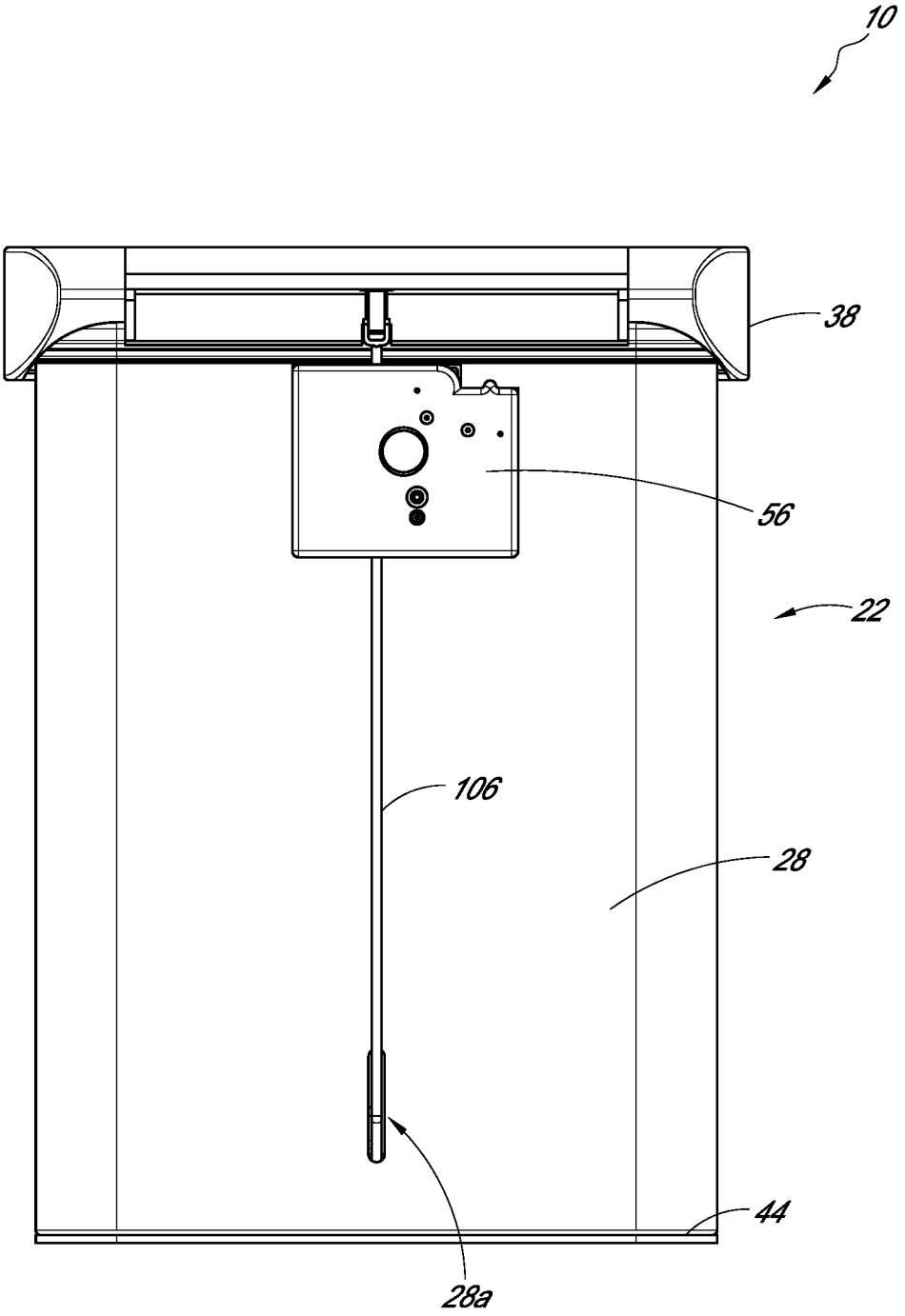
FIG. 4 illustrates a rear elevation view of the trash can shown in FIG. 2.
Figure 5:
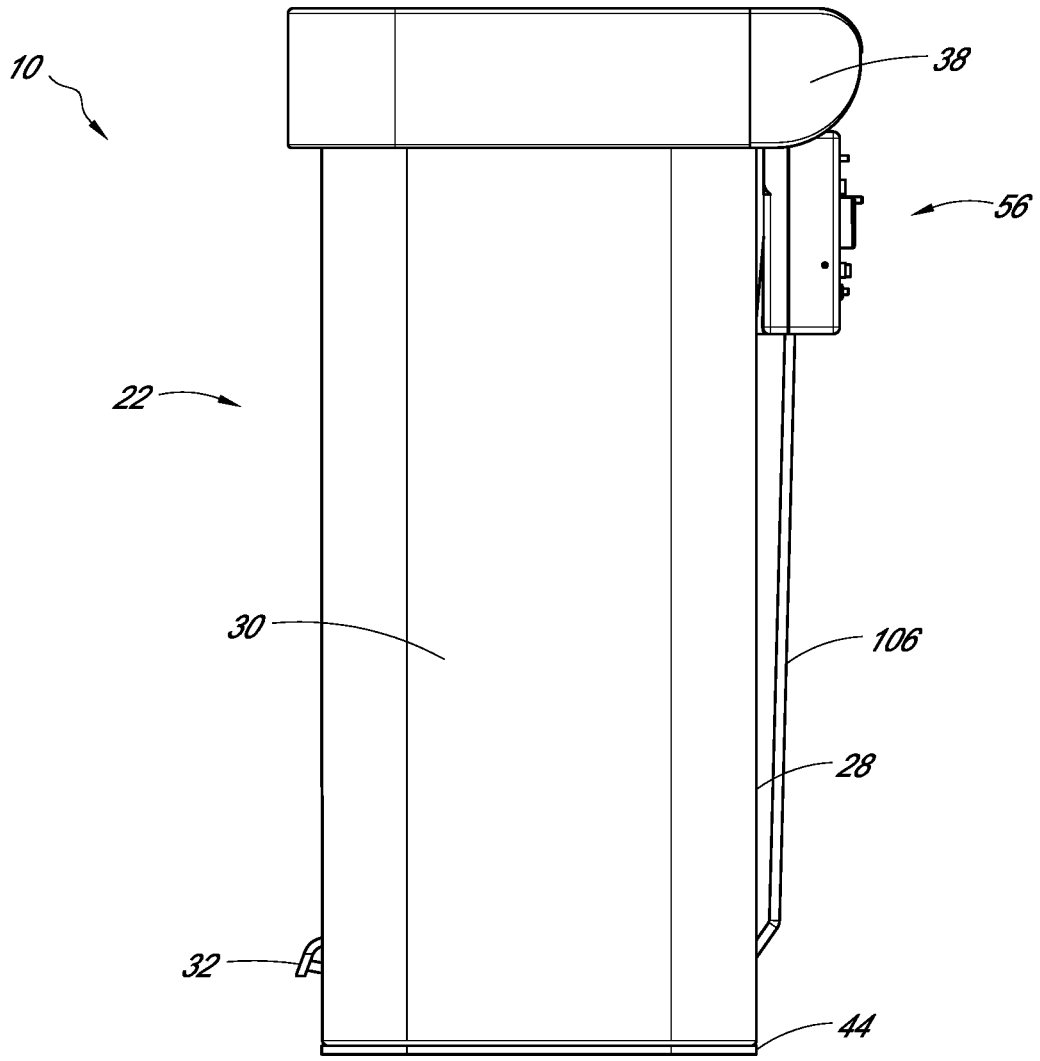
FIG. 5 illustrates a left side elevation view of the trash can shown in FIG. 2.

As shown in FIG. 4, the body portion 22 can include a support or an enclosure, such as housing 56. The housing 56 can contain the energy control mechanism, which can control movement of the lid 24, and is discussed in greater detail below. In some embodiments, the housing 56 can include one or more electronic actuators, such as a power button for turning on and off power to one or more features of the trash can assembly 10. The housing 56 can include an opening for a linkage to enter and/or exit the housing 56.

The housing 56 can have a generally low profile configuration. For example, the housing 56 can extend rearward from the rear wall 28 a distance of less than or equal to about the distance from the rear wall 28 to the furthest rearward extent of the lid portion 24 and/or the furthest rearward extent of a upper support member 38 (discussed below). For example, the housing 56 can extend rearward less than or equal to about 1 inch, or less than or equal to about ⅕th of the distance between the outside surfaces of the rear wall 28 and the front-most portion of the front wall 29. In various embodiments, when the trash can assembly 10 is placed against a vertical wall (e.g., a kitchen cabinet), with the rear wall 28 of the trash can assembly 10 adjacent and generally parallel to the vertical wall, the housing 56 is horizontally spaced apart from the vertical wall and/or does not contact the vertical wall.

As noted above, the trash can assembly 10 can include an upper support member 38. In some embodiments, the upper support member 38 (such as a trim ring) can secure or retain an upper portion of the bag liner between the upper support member 38 and the upper edge of the body portion 22. The upper support member 38 can generally surround at least a portion of the body portion 22 so as to form a secure support or connection and/or to be positioned at least partially above the body portion 22.

As illustrated, a diameter of the upper support member 38 can be greater than a diameter of the upper portion of the body portion 22, such that the upper support member 38 can receive, nest with, and/or removably lock onto the upper edge of the body portion 22, e.g., by a friction fit. When a bag liner is placed in the body portion 22 and the upper portion of the bag liner is positioned over the rolled edge or annular lip of the upper edge, the upper support member 38 can be positioned (e.g., rotated into position) such that the bag liner is disposed between the upper support member 38 and the body portion 22. The upper support member 38 can secure a portion of the bag liner within the body portion 22 and prevent the bag liner from falling into the body portion 22.

Some embodiments of the upper support member 38 can rotate with respect to the body portion 22 and/or the lid portion 24. The upper support member 38 can be made of various materials, such as plastic or metal. The upper support member 38 and the body portion 22 can be made from the same or different materials. For example, the upper support member 38 and the body portion 22 can be constructed from a plastic material. Some embodiments of the upper support member 38 can engage and/or overlap the upper edge of the trash can assembly 10.

The upper support member 38 can be pivotably coupled to the trash can assembly 10. For example, the lid portion 24 and the upper support member 38 can pivot generally along the same pivot axis. In some embodiments, the upper support member 38 includes a retaining mechanism to maintain the upper support member 38 in an open position while the bag liner is being replaced or the trash can interior is cleaned. The upper support member 38 can be configured to allow air to flow into a space between the liner and an interior surface body portion 22. For example, the upper support member 38 can include one or more vents.

II. Lid Actuating Assembly

Figure 6:
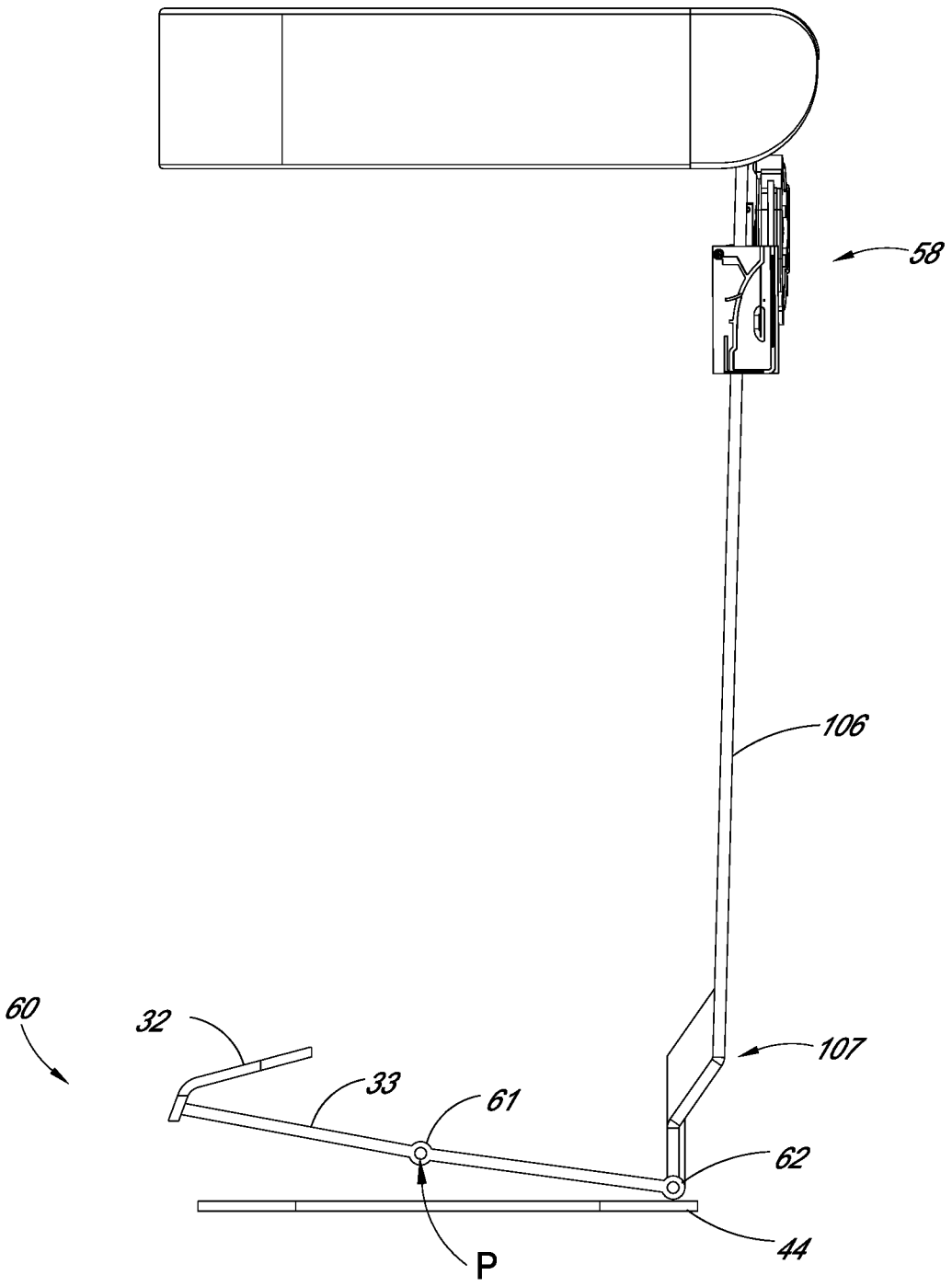
FIG. 6 illustrates a left side partial view of a lid actuating assembly of the trash can assembly shown in FIG. 2.
Figure 7:
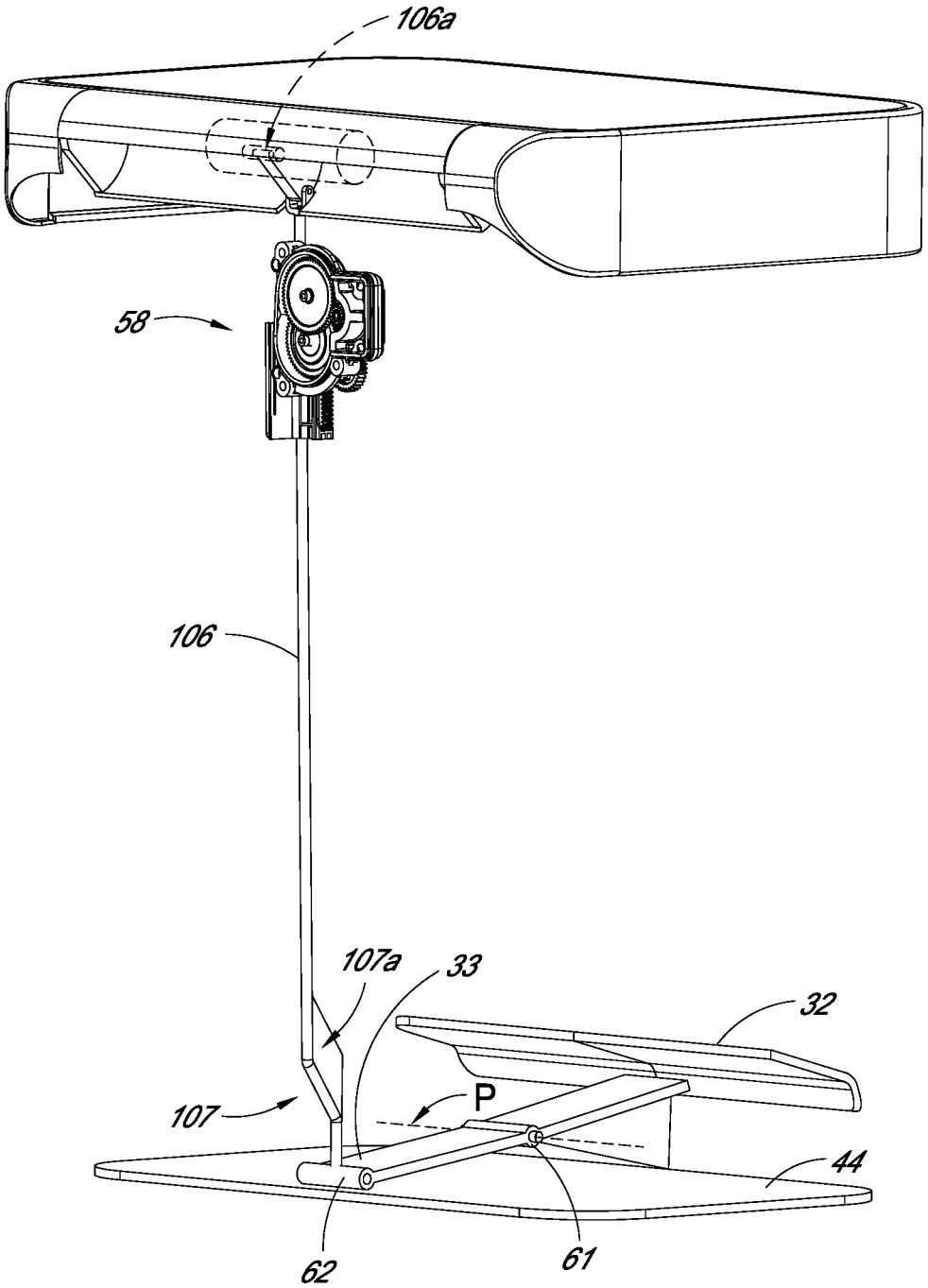
FIG. 7 illustrates a rear perspective partial view of the lid actuating assembly shown in FIG. 6, including an energy control mechanism housed in an outer housing.
Figure 8:
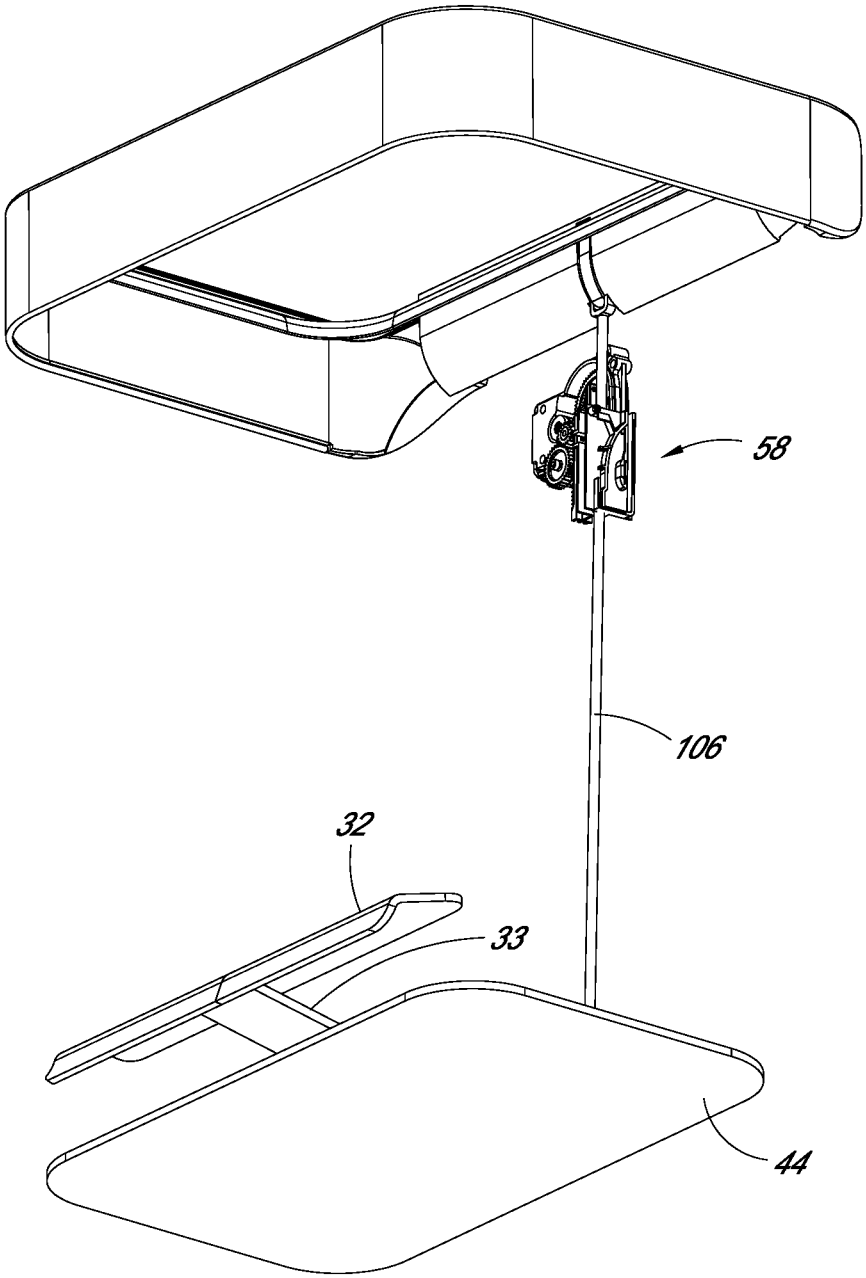
FIG. 8 illustrates an underside perspective partial view of the lid actuating assembly shown in FIG. 6.

With reference to FIGS. 6-8, an example of the lid actuating assembly 60 is illustrated. For purposes of presentation, certain other portions of the trash can assembly 10 are not shown in these figures, such as the body portion 22 and the lid 24. In various embodiments, the lid actuating assembly 60 is configured to move the lid 24 from the closed to opened positions when the pedal 32 is moved from the resting position to the actuated position. As used herein, the phrase "resting position" of the pedal 32 can refer to a position in which a user is not applying a force to the pedal 32 and/or can refer to a position where the pedal 32 is pivoted or otherwise moved towards an upper position, such as is shown in FIG. 6. The "actuated position" of the pedal 32 refers to the position of the pedal 32 when a user applies a force to the pedal 32 and/or when the pedal 32 is pressed downwardly, for example, by the foot of a user.

As shown, the lid actuating assembly 60 can include the pedal 32 and a lever arm 33. The pedal 32 may be monolithically formed with the lever arm 33, or the pedal 32 and the lever arm 33 may be made from separate materials and then joined, such as with a mechanical fastener, welding, or otherwise. As shown, the pedal 32 connects with a proximal or front portion of the lever arm 33.

To allow for movement between the resting position and the actuated position, the lever arm 33 can be supported by at least one pivot connection 61, such as a pinned connection. The pivot connection 61 can be fixedly connected with the base 44 and/or with the body portion 22, such as with a generally horizontally extending shaft. As shown in FIG. 6, in some embodiments, the pivot connection 61 is located at about a midpoint in the depth (e.g., in the front to back direction) of the base 44. In some variants, the pivot connection 61 is located closer to the front wall 29 than the rear wall 28. In some variants, the pivot connection 61 is located closer to the rear wall 28 than the front wall 29.

The pivot connection 61 can be configured such that the lever arm 33 and the pedal 32 rotate partially around the pivot connection 61 when the pedal 32 moves between the resting and the actuated positions. In various embodiments, the amount that a point on the pedal 32 rotates around the pivot connection 61 is at least about: 15°, 25°, 30%, 35%, values between the aforementioned values, or other values. In some embodiments, when the pedal 32 moves from the resting position to the actuated position, the distance that the pedal 32 travels along a vertical line tangent to the arc of rotation of the pedal 32 around the pivot connection 61 is at least about: 30 mm, 40 mm, 42 mm, 45 mm, 51 mm, 55 mm, 60 mm, 70 mm, values between the aforementioned values, or other values.

With continued reference to FIGS. 6-8, a distal or rear portion of the lever arm 33 may be connected, such as via pivot connection 62, to a lower linkage 107 and an upper linkage 106. The lower linkage 107 can include a bend and/or a support portion, such as a brace 107*a*. The lower linkage 107 and/or the upper linkage 106 can extend through the aperture 28*a* in the rear wall 28 of the body portion 22. As shown, the upper linkage 106 can extend upwardly into the housing 56 and/or can connect with the energy control mechanism 58, as discussed below.

Figure 9:
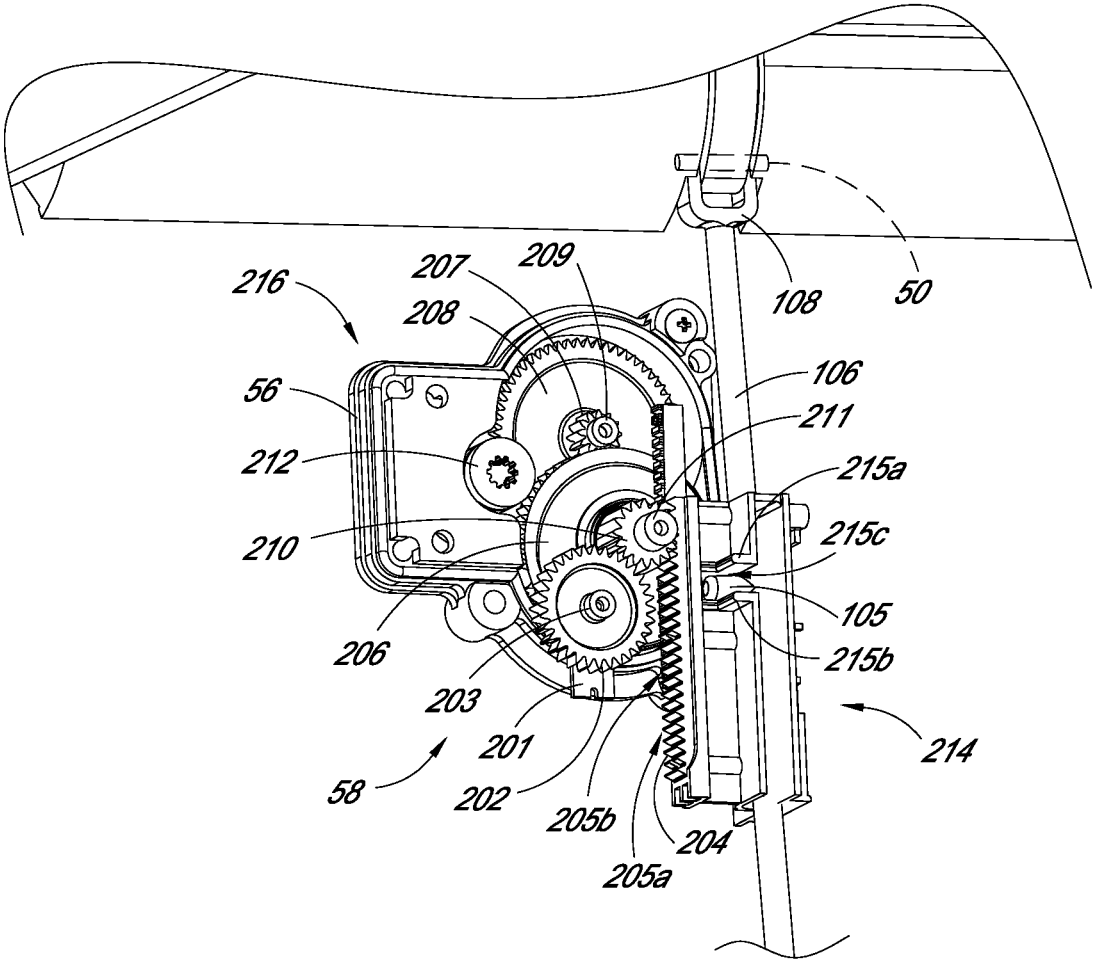
FIG. 9 illustrates the energy control mechanism of the lid actuating assembly shown in FIG. 6, with the outer housing removed.

Typically, the linkage rod 106 includes an upper portion, such as an upper end 106*a* that can connect and/or interface with the lid 24. For example, as shown in FIG. 9, the upper end of the linkage rod 106 can have an interface, such as a forked portion 108, that interfaces with a pivot 50 such that the lid 24 can pivot above the axis defined by the pivot 50. In various embodiments, the upper linkage 106 and the lid 24 are configured such that the upward movement of the upper linkage 106 translates into pivotal movement of the lid 24 relative to the upper linkage 106.

In the illustrated embodiment, when the pedal 32 is in the resting position, the distal end of the lever arm 33 is pivoted downwardly. In this position, the linkage rod 106 is located in a downward position, which corresponds to the lid 24 being in a closed position. When a user steps on the pedal 32, the pedal 32 pivots downwardly, which pivots the front portion of the lever arm 33 around the pivot mechanism 61. This causes the rear of the lever 33 to pivot upwardly, thereby lifting the linkage rod 106. As the linkage rod 106 rises, the forked portion 108 presses against the lid 24, thereby moving the lid 24 from the closed position toward the open position.

The lid 24 and the pedal 32 can be biased toward the closed and resting positions, respectively, in many different ways, such as with a spring or other biasing member. For example, the weight of the lid 24 can be sufficient to move the lid 24 toward the closed position when substantially nothing (other than gravity) is depressing the pedal 32. In some implementations, the trash can assembly 10 includes one or more biasing members, such as springs, to bias the lid 24 toward the closed position, and/or the pedal 32 to the resting position.

III. Energy Control Mechanism

Figure 10:
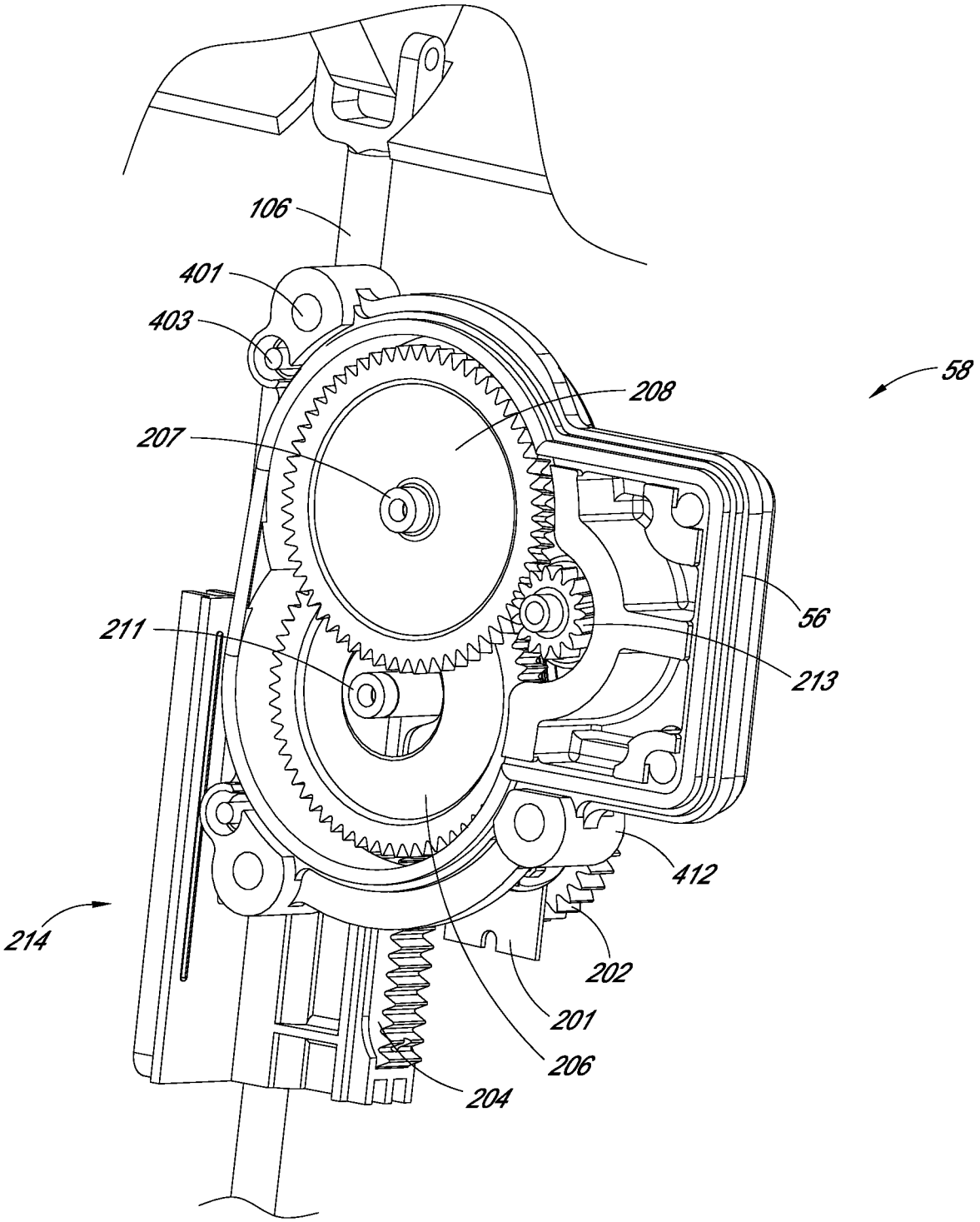
FIG. 10 illustrates another perspective view of the energy control mechanism shown in FIG. 9.
Figure 11:
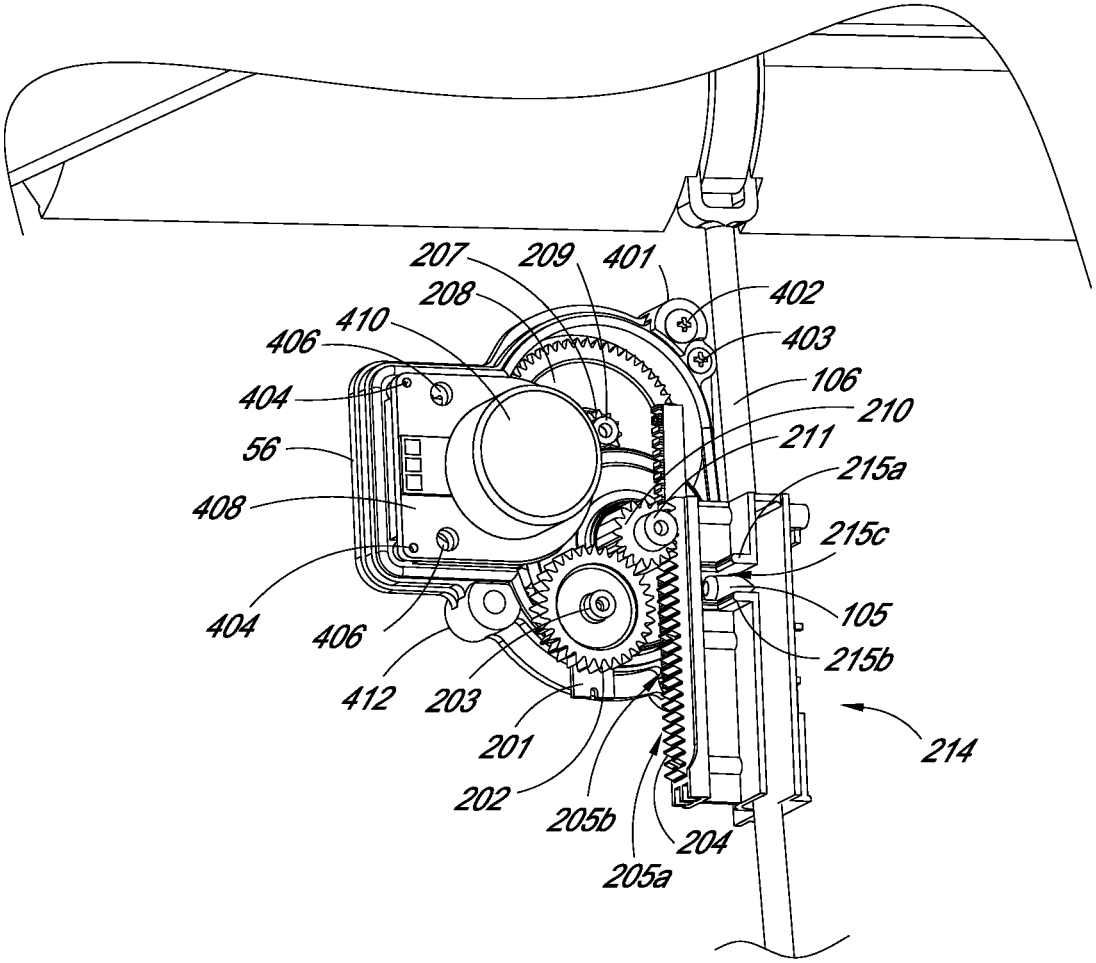
FIG. 11 illustrates another perspective view of the energy control mechanism shown in FIG. 9.

As mentioned above, the housing 56 (FIG. 4) can house an energy control mechanism 58. An example of the energy control mechanism 58 is shown in FIGS. 9-11. For purposes of presentation, certain other portions of the trash can assembly 10 are not shown, such as a portion of the housing 56. The mechanism 58 can include an energy recapture system and/or a resistive load control system, as is discussed in more detail below. Various embodiments can include one, both, or neither of the resistive load control system and the energy recapture system.

A. Resistive Load Control System

In some embodiments, the energy control mechanism 58 includes features that can resist, dampen, and/or otherwise control the movement of the lid 106. For example, the mechanism 58 includes features that control the amount of load needed to open the lid 24, which can affect the opening speed of the lid 106. For example, the mechanism 58 can include one or more features that can influence the rate of opening of the lid 106 to change over the course of at least a portion (e.g., at least two or more different points) of the opening movement, such as beginning quickly and ending slowly. This can reduce the time a user needs to wait for the lid to initially open, thereby providing a more pleasant user experience. Furthermore, this can reduce the momentum of the lid as it nears the fully open position, which can reduce the chance of the lid striking an adjacent wall and causing undesirable noise or damage.

In certain embodiments, the mechanism 58 can include features that control the amount of load needed to close the lid 24, which can affect the closing speed of the lid 106. For example, the mechanism 58 can include one or more features that can influence the rate of closing of the lid 106 to change over the course of at least a portion (e.g., at least two or more different points) of the closing movement, such as beginning quickly and ending slowly. This can reduce the time that the lid 106 is near the fully open position, which can reduce the escape of odors from the trash can assembly 10. Moreover, this can reduce the momentum of the lid 24 when it nears the fully closed position, which can reduce noise caused by the lid 106 striking the body portion 22 and/or trim ring 38. In some embodiments, the one or more regions or one or more points where the movement is influenced to slow down are different during the opening phase than in the closing phase, such that the system exhibits hysteresis along the opening and closing paths.

As shown in FIGS. 9-11, the energy control mechanism 58 can include any suitable mechanism for controlling energy, such as a plurality of gears and/or a gear train. The gears can serve various functions. For example, one or more of the gears can translate the generally linear motion of the linkage 106 into rotational motion, one or more of the gears can transfer the rotational motion, and/or one or more of the gears can connect with a resistance control unit 201, which can control the torque needed to turn the gears. As discussed below, the gears, and/or other components of the mechanism 58, can control the movement of the linkage rod 106 such that the lid 24 opens and closes smoothly. In some embodiments, additional dampening mechanisms are not needed. For example, various embodiments of the trash can assembly 10 do not include and/or do not require a fluid damper.

As illustrated in FIG. 9, the mechanism 58 may include a linear actuator, such as a rack and pinion. This can translate the linear motion of the linkage rod 106 into rotational motion. In some embodiments, a projection 105 on the linkage rod 106 engages with (e.g., fits within) an opening 215*c* formed by flanges 215*a* and 215*b* of a rack housing 214. The physical interference of the projection 105 with the flanges 215*a* and 215*b* allows the rack housing 214 to move upward and downward with the linkage rod 106. As shown, a linear gear bar or rack 204 can be coupled with the rack housing 214. The linear gear bar or rack 204 may be formed monolithically with the rack housing 214 or may be formed separately and joined to the rack housing 214, such as with a mechanical or adhesive fastener. The rack 204 can be engaged with a pinion gear 210, such as by mating engagement of the teeth on the rack 204 and pinion 210.

In certain implementations, the teeth on the rack 204 have substantially the same size (e.g., thread root to crest height) and/or spacing (e.g., thread pitch). In some embodiments, the teeth on the rack 204 have different sizes and/or different spacing. This can aid in controlling and/or varying a rate of movement (e.g., ascent and/or descent) of the linkage rod 106 relative to the circular pinion gear 210.

As illustrated in FIG. 9, the rack 204 includes teeth 205*a* and 205*b*. The teeth 205*a* are located at the distal ends of the rack 204 and are at a wider spacing than the teeth 205*b*, which are located at a central portion of the rack 204. In some variants, as the linkage rod 106 moves from a lower or lowest position (corresponding to a closed position of the lid 24) or a higher or highest position (corresponding to an open position of the lid 24), the teeth of the pinion gear 210 mesh or engage with the widely spaced teeth 205*a* of the rack 204. The wider spacing allows the rack housing 214 (as well as the linkage rod 106), to move upwardly at a faster rate, compared to when the teeth of the pinion gear 210 mesh or engage with the closely spaced teeth 205*b* of the rack 204.

In some embodiments, the pinion gear 210 is engaged with a coupling gear 202. The illustrated gear 202 has 32 teeth, which results in a gear ratio of 2:1 with the pinion gear 210. In other embodiments, the gears 202, 210 may each have more or fewer teeth, resulting in different gear ratios, such as at least about: 1.25:1, 1.5:1, 1.75:1, 2:1, 2.25:1, 2.5:1, 3:1, values between the aforementioned values, and otherwise. In some variants, the gear ratio is at least about 1.4:1 and/or less than or equal to about 2.6:1.

The gear 202 is connected to a resistance control unit 201, such as via a shaft 203. The resistance control unit 201 can comprise any suitable mechanism and/or electronic components for providing a resistance, such as a mechanical resistance to motion. For example, the resistance control unit 201 can comprise a potentiometer. In various embodiments, the resistance control unit 201 is configured to control and/or vary the amount of torque required to turn on the shaft 203. This can be transmitted to the linkage 106, such as via the gear 202, pinion 210, rack 204, and rack housing 214. Thus, the resistance control unit 201 can control and/or vary the resistive load acting on the linkage 106 and thus the lid 24. As used herein the term "resistive load" means the amount of force applied by the resistance control unit 201 to oppose or resist the external force applied (e.g., by a user's foot or by gravity) to either open or close the container. In some embodiments, the resistive load is applied by the resistance control unit 201 to the linkage 106. In various embodiments, the resistance control unit 201 can control and/or vary the rate at which the linkage 106 and/or the lid 24 moves, such as when the pedal 32 is depressed or released by a user. The resistance control unit 201 can control and/or vary the rate at which the lid 24 moves (e.g., opens or closes) in various other ways, with or without a linkage 106, by providing a suitable functional connection between the resistance control unit 201 and the opening and/or closing of the lid. This can enable the resistance control unit 201 to provide electronic dampening of the lid 24 without requiring other damping sources, such as fluid dampers.

In some embodiments, the resistance control unit 201 can provide varying (e.g., adjustable, variable, adaptable, etc.) levels of resistance (e.g., electrical resistance and/or mechanical resistance) and/or can convert such resistance into a resistive load, which can be a type of mechanical resistance. For example, the resistance control unit 201 can be configured to vary an amount of resistance of the stator of a generator 216 (e.g., the amount of resistance in opposes to a rotational force) based on a position of the lid 24, as is discussed in more detail below. Because, in some embodiments, movement of the lid 24 is directly or indirectly related to rotation of a rotor 212 of the generator 216, by changing the current and/or resistance of the stator with the resistance control unit 201, the mechanical movement of the lid 24 can be controlled (e.g., based on rotation of rotor 212). In some embodiments, the electrical resistance is at least about 5 Ohms and/or less than or equal to about 25 Ohms. In some embodiments, electrical resistance is inversely correlated with resistive load. For example, as electrical resistance decreases, the resistive load on the linkage 106 and/or lid 24 increases. In some implementations, the resistance control unit 201 includes a frictional, pneumatic, hydraulic, or other component able to providing varying amounts of resistive load to the linkage 106 (e.g., via the gear train 202, 204, 210, 214 described above in some embodiments).

The resistance control unit 201 can be controlled by a controller, such as a device with a microprocessor and memory. The controller can be part of the resistance control unit 201 or external to it. In some embodiments, the controller can receive lid position signals from a lid position sensor such as an infrared sensor, proximity sensor, ultrasonic sensor, or otherwise. The controller can be configured to determine the location of the lid 24 (e.g., the percent that the lid is open) and/or the movement of the lid (e.g., whether the lid 24 is opening, closing, or stationary). The controller can use such information to determine the amount of resistive load that should be applied and can instruct the resistance control unit 201 accordingly.

In some embodiments, the amount of resistive load that the resistance control unit 201 applies to the linkage 106 and/or the lid 24 varies over the course of movement of the lid 24, such as when the lid 24 is opening. For example, when the lid 24 is initially moved from a fully closed position toward a fully open position, a relatively small amount of resistive load is initially applied. This makes the lid 24 feel "lighter" to the user as the user presses the pedal 32. As the lid 24 continues to open, in some embodiments, the resistive load can increase (e.g., as a function of the percent open of the lid), either continuously along all or a portion of the closed-to-open path, or discretely such that at least two points along the closed-to-open path can provide different levels of resistive load, which can make it progressively more difficult to open the lid 24. This can decrease the momentum of the lid 24 as it nears or reaches the fully open position, which can inhibit or prevent the lid 24 from banging or impacting an adjacent wall behind the trash can assembly 10. In some variants, the increase in resistive load as the lid 24 opens provides feedback to the user regarding the extent that the lid 24 is opened and/or can alert the user that the lid 24 is nearing the fully open position.

In certain embodiments, the amount of resistive load applied to the linkage 106 (and thus the lid 24) varies as the lid 24 is closing. For example, the resistance control unit 201 can initially provide a relatively small amount of resistive load, which can allow the lid 24 to begin closing with a high rate of speed and/or can reduce the time until the lid 24 is near the fully open position, thereby reducing the escape of odors from the trash can assembly 10. As the lid 24 continues to close, in some embodiments, the resistive load can increase (e.g., as a function of the percent closed of the lid), either continuously along all or a portion of the open-to-closed path, or discretely such that at least two points along the open-to-closed path can provide different levels of resistive load, which can make it progressively more difficult to close the lid 24. As the lid 24 reaches the closed position, the amount of resistive load provided by the resistance control unit 201 can reach a peak. This increase in resistive load can reduce the momentum of the lid 24 as it nears the fully closed position, which can reduce noise caused by the lid 24 striking the body portion 22 and/or the trim ring 38 and causing undesirable noise or damage. Various embodiments thus can inhibit or prevent the lid 24 from slamming closed.

In some embodiments, the resistance control unit 201 applies an initial electrical resistance, such as about 25 Ohms (e.g., when the lid 24 is substantially in the fully open or fully closed position) and an ending electrical resistance that is different from and/or smaller than the initial electrical resistance, such as about 5 Ohms, such as when the lid 24 is opening and is at or near the fully open position or when the lid 24 is closing and is at or near the fully closed position. In some implementations, the amount of force applied by the resistance control unit 201, as measured at the lid 24, is low (e.g., less than or equal to about: 1 Newton (N), 2 N, 3 N, 4 N, values between the aforementioned values, or other values), such as when the lid begins movement from the fully open position or the fully closed position. In certain variants, the amount of force applied by the resistance control unit 201, as measured at the lid 24, is high (e.g., at least about: 8 N, 9 N, 10 N, 11 N, 12 N, values between the aforementioned values, or other values), such as when the lid is opening and is near or at the fully open position, or when the lid is closing and is near or at the fully closed position.

Figure 12:
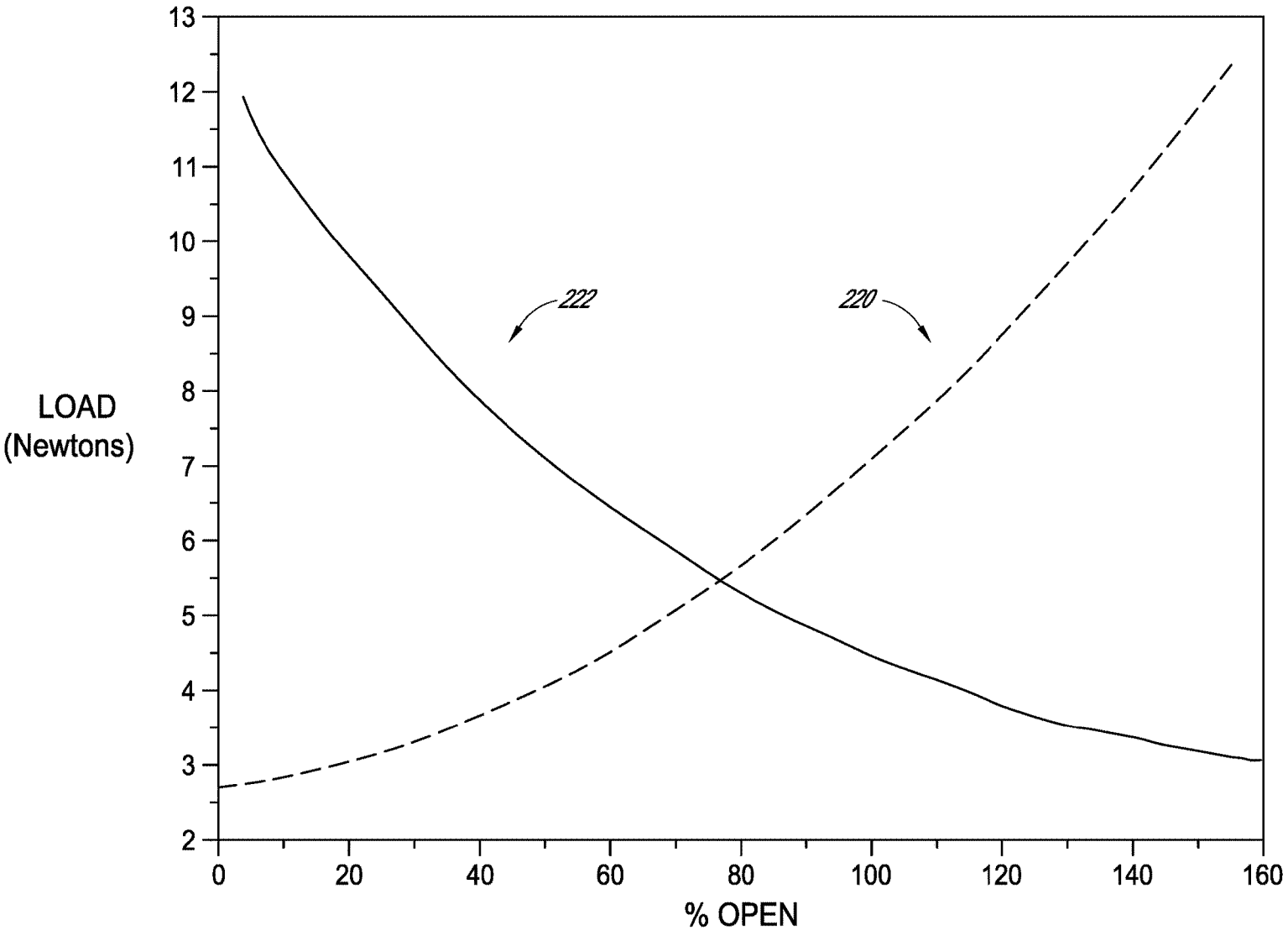
FIG. 12 illustrates an example of a resistive load profile for energy generation.

Some examples of resistive load profiles are illustrated in FIG. 12. Many other types of profiles can be used. The curve 220 illustrates an example profile for opening the lid 24 and the curve 222 illustrates an example profile for closing the lid 24. Because, in some embodiments, the lid 24 can be moved beyond a fully open position (e.g., a generally vertical position), FIG. 12 indicates open percentages that are greater than 100%.

As shown on curve 220, when the lid 24 is being opened, the resistive load can begin relatively small (e.g., compared to the ending load), such as when the lid is fully closed (e.g., the percent open is about 0). As the percent open of the lid 24 increases, the load increases generally continuously, thereby making the lid 24 increasingly difficult to open. With regard to curve 222, at the beginning of the closing of the lid (e.g., when the lid is fully open at 100 percent or more), the resistive load can be relatively small, such as compared to the ending load. As the percent open of the lid 24 decreases, the can load increase, thereby making the lid 24 increasingly difficult to close.

As shown, in some implementations, the amount of load on curve 220 when the lid 24 is about 0% open is less than the amount of load on curve 222 when the lid is about at 100% open. This can make the lid 24 initially open faster than it initially closes. In some variants, the amount of load on curve 220 when the lid is about 0% open is about equal to or greater than the amount of load on curve 222 when the lid is about at 100% open, which can make the lid 24 initially close faster than it initially opens or at least initially open and close at about the same rate.

Various resistive load profiles are contemplated. For example, although the curve 220 is directly correlated with the percent open of the lid 24 and the curve 222 is indirectly correlated with the percent open of the lid 24, such relationship can be reversed, or both curves 220, 222 can be directly or indirectly related to the percent open of the lid 24. Furthermore, although the curves 220, 222 are approximately parabolic or exponential functions of the percent open of the lid 24, in some embodiments, one or both of the curves 220, 222 can be one or more of a linear function, a step function, a logarithmic function, etc., of the percent open of the lid 24. Moreover, some embodiments are based on a percent closed of the lid 24.

B. Energy Recapture System

In some implementations the energy control mechanism 58 includes one or more features that can recapture energy of other components of the trash can assembly 10. For example, as discussed below, the energy control mechanism 58 can include one or more features to capture kinetic energy from the lid 24, or foot pedal, or linkage rod, and/or one or more other moving components of the container, during movement of any of such components, such as when the lid 24 is closing. The energy can be stored for use by other components of the container, as is discussed further below.

With reference again to the pinion gear 210 as shown in FIGS. 9-11, in some embodiments, the pinion gear 210 is coupled with a first transmission gear 206 such that rotation of the pinion gear 210 is transmitted to the first transmission gear 206. The gears 206, 210 can be coupled so as to rotate substantially together. For example, the pinion gear 210 and the first transmission gear 206 may each be fixedly mounted on a common shaft 211. In some embodiments, the pinion gear 210 and the first transmission gear 206 may be monolithically formed.

In the illustrated embodiment, the pinion gear 210 has a smaller diameter than the first transmission gear 206. When the gears 206, 210 rotate, the teeth of the pinion gear 210 can have an angular velocity that is less than the angular velocity of the teeth of the first transmission gear 206. In some embodiments, such as the embodiment shown in FIGS. 9 and 11, the pinion gear 210 has 16 teeth and the first transmission gear 206 has about 60 teeth, resulting in a first transmission gear ratio of about 3.75:1. In some embodiments, the pinion gear 210 and the first transmission gear 206 may each have more or fewer teeth, resulting in different gear ratios, such as at least about: 1.5:1, 2:1, 2.5:1, 3:1, 3.5:1, 4:1, 4.5:1, values between the aforementioned values, and otherwise. In some variants, the gear ratio is at least about 2:1 and/or less than or equal to about 5:1.

The teeth of the first transmission gear 206 can be mesh or engage with the teeth of a coupling gear 209. The coupling gear 209 may have a plurality of teeth, such as about 12 teeth, resulting in a coupling gear ratio of greater than 1:1, such as about 5:1 between the coupling gear 209 and the first transmission gear 206. This means that for every one rotation of the first transmission gear 206, the coupling gear 209 rotates more than one rotation, such as about five rotations.

Similar to the gears 206, 210 discussed above, the coupling gear 209 may be coupled with a second transmission gear 208 such that rotation of the coupling gear 209 is transmitted to the second transmission gear 208. The gears 208, 209 can be coupled so as to rotate substantially together. For example, gears 208, 209 can each be fixedly mounted on a common shaft 207. In some embodiments, the gears 208, 209 are monolithically formed.

The illustrated second transmission gear 208 has 60 teeth, resulting in a second transmission gear ratio of 5:1. In other embodiments, the coupling gear 209 and the second transmission gear may each have more or fewer teeth, resulting in gear ratios different gear ratios, such as at least about 1.5:1, 2:1, 2.5:1, 3:1, 3.5:1, 4:1, 4.5:1, values between the aforementioned values, and otherwise. In some variants, the gear ratio is at least about 2:1 and/or less than or equal to about 5:1.

Thus, as described above, the energy control mechanism 58 can include many type of mechanisms, such as gear mechanisms and/or other mechanisms. The energy control mechanism 58 can include any type of gear train (e.g., via the housing 214, rack 204, pinion gear 210, first transmission gear 206, coupling gear 207, and/or second transmission gear 208, etc.), which can in some embodiments transmit motion from the linkage 106, which is mechanically connected with the pedal 32. In several embodiments, this motion can be transmitted to a rotor 212 of an electric generator 216. The kinetic energy provided by the user at the pedal 32 upon opening or by the force of gravity upon closing can be transferred to the electric generator 216 and converted into electrical energy. In some embodiments, one downward stroke of the pedal 32 has a vertical travel (as measured at the frontmost edge of the pedal 32) of at least about 42 mm and/or less than or equal to about 55 mm and yields at least about 1 joule and/or less than or equal to about 1.5 joules of electrical energy.

The generator 216 can provide electrical energy in any suitable way. In some embodiments, the generator 216 includes the rotor 212 and a stator (not shown). As shown in FIG. 10, the rotor 212 can be fixedly attached with a rotor gear 213, which in turn can be engaged with the second transmission gear 208. Thus, rotation of the second transmission gear 208 can be transferred to the rotor gear 213 and the rotor 212, which can rotate relative to the stator (not shown) to generate electrical energy. In some embodiments, the rotor gear 213 may have 15 teeth, such that a gear ratio between the second transmission gear 208 and the rotor gear 213 is greater than 1:1, such as about 4:1, such that the rotor gear 213 rotates multiple times (e.g., four times) for every one revolution of the second transmission gear 208. Various other gear ratios are contemplated, such as any of the other gear ratios disclosed in this specification.

In some embodiments, such as is shown in FIG. 11, the stator is housed and/or enclosed in a stator cover 410, which can be received over and/or adjacent the rotor 212. As the rotor 212 rotates within the stator (e.g., coil), electrical energy is generated and collected. This energy may be used substantially immediately and/or stored in one or more electrical energy storage devices (not shown), such as one or more capacitors, rechargeable batteries, etc. The electrical energy storage device can be positioned in the housing 56 or elsewhere, such as in an upper portion of the trash can assembly 10 (e.g., the lid 24) and/or in a lower portion of the trash can assembly 10 (e.g., the base 44).

In some embodiments, some or all of the energy control mechanism 58 is positioned in the housing 56. This can provide protection to the energy control mechanism 58 and/or can reduce the likelihood of an article being caught in the gears. In some embodiments, the stator cover 410 may be part of a stator housing surface 408 that is secured to the housing 56, such as with fasteners (e.g., screws) that engage and/or pass through openings 404, 406. In some embodiments, the housing 56 has an inner cover and an outer cover that mate together. As shown in FIG. 11, fasteners (e.g., screws 402, 403) may be used to secure the outer cover of the housing 56 to the inner cover of the housing 56. The housing 56 may be formed with securing openings 401 and 412 that may be configured to align with matching securing openings on the outer cover of the housing 56 for ease of assembly.

In various embodiments that include both the energy recapture system and the resistive load control system, the energy recapture system provides a resistive load that is in addition to the resistive load provided by the resistance control unit 201. For example, the force required to turn the rotor 212 provides a resistive load other than the resistive load applied by the resistance control unit 201. Moreover, the friction between each engaging gear in the gear train between the pinion gear 210 and the rotor 212 provides a resistive load other than the resistive load applied by the resistance control unit 201.

Although the energy control mechanism 58 is shown and described in connection with pedal-operated trash cans, the mechanism 58 can also be used to capture energy during the movement of one or more of any other components in any other types of containers, such as containers for other types of articles, or containers with motor operated lids and/or sensor-activated lids (e.g., during the gravity-assisted closing phase), or containers that are manually and/or lever operated. Examples of some such trash cans are described in U.S. Patent Application Publication No. 2013/0233857, filed Mar. 6, 2013, the entirety of which is hereby incorporated by reference in its entirety.

IV. Certain Energy Using Components

Various embodiments of the trash can assembly 10 include components that can use electrical energy. Such energy can be provided by one or more energy storage devices (e.g., rechargeable or non-rechargeable batteries, capacitors, etc.). As noted above, the energy recapture system of the energy control mechanism 58 can generate and store electrical energy, such as in the energy storage devices. In some embodiments, the trash can assembly 10 or other container includes a connection to access an external power source, such as a plug to access a wall outlet with domestic power.

In certain embodiments, the electrical energy is used to power a light. This can provide illumination of the inside or outside of the body portion 22, such as when the lid 24 is opened, or when the surroundings of the container are dark, to provide a night light. Some embodiments use the electrical energy to operate a clock, date, or other display on an outer surface of the container. The electrical energy may be used to power a computer processor and/or an indicator, such as a light emitting diode (LED). In some embodiments, the indicator (e.g., LED) can indicate when it is time to empty the container, replace the liner, and/or obtain additional liners. Some embodiments use the electrical energy to power a meter, such as an indicator of the amount of electrical power stored in the energy storage devices and/or whether the trash can assembly 10 is recapturing power.

Some embodiments use the electrical energy to power a motor that aids in opening the lid 24. For example, the trash can assembly 10 can include a sensor that detects that the pedal 32 is being depressed and sends a signal to the controller. The controller can signal the motor to operate to provide force to aid in opening the lid 24. This can reduce the force that a user needs to apply to the pedal 32. In some embodiments, after the motor has started to aid in opening the lid 24, the user does not need to continue to press on the pedal 32, and the motor will continue to drive the lid 24 to the open position.

In certain embodiments, the energy generated by the mechanism 58 is used to remediate or diminish odor emanating from a trash container, such as by generating ions. For example, the electrical energy can be provided to an ion generator (not shown). In some embodiments, the ion generator is located in the lid 24. This can allow the ion generator to discharge the ions generally downwards into the container, such as when the lid 24 is opened. In some embodiments, the ion generator is located in the base 44 and/or body portion 22 and configured to discharge ions generally downwardly, generally upwardly, and/or radially inwardly into the container. In certain embodiments, the ions are generated with ultraviolet (UV) lighting. Other embodiments do not use UV lighting and can exhibit increased energy efficiency.

The ions can be used to reduce and/or control odor. For example, the ions can interact with odor molecules in the container (e.g., from refuse in the container), which can cause odor molecules to become charged and/or increase in weight. The increase in weight can increase the likelihood that the ionized odor molecules will be pulled downwardly into the container by gravity, rather than escaping outside of the container into the environment when the lid 24 is open.

In some implementations, the charged odor particles are drawn to and/or captured by an attractor, such as a metal plate. Typically, the attractor is oppositely charged compared to the ions such that it attracts the charged odor particles. Further, in some variants, the attractor can hold the charged odor particles, such as during the time period that power is applied to the attractor. The attractor can be located in or near the base portion 44. Power can be provided to the attractor in any of the ways discussed above or otherwise, such as by batteries.

In some embodiments, the ion generator operates (e.g., discharges ions) generally continuously. This can aid in reducing odor by providing a constant stream of ions to interact with odor molecules in the container. However, as this typically requires a continuous supply of power, some embodiments are configured such that the ion generator operates generally continuously, discontinuously, or only under certain circumstances. For example, in some embodiments, operation of the ion generator is permitted only if the trash can assembly 10 has as generally continuous external power supply (e.g., is plugged in to a wall outlet) and/or if the amount of power in the energy storage devices is equal to or greater than a threshold amount.

In some embodiments, the ion generator operates (e.g., discharges ions) intermittently. For example, the ion generator can operate when the lid 24 is open, when the lid 24 is moving, and/or when the lid 24 is not in the fully closed position. This can aid in reducing odor during a user's interaction with the trash can assembly 10 while also reducing overall power consumption compared to the generally continuous operation discussed above.

V. Summary

Although various containers, such as trash can assemblies, have been disclosed in the context of certain embodiments and examples, the present disclosure extends beyond the specifically disclosed embodiments to other alternative embodiments and/or uses of the trash cans and obvious modifications and equivalents thereof. In addition, while several variations of the trash cans have been shown and described in detail, other modifications, which are within the scope of the present disclosure. For example, a gear assembly and/or alternate torque transmission components can be included. This disclosure expressly contemplates that various features and aspects of the disclosed embodiments can be combined with, or substituted for, one another.

For expository purposes, the term "lateral" as used herein is defined as a plane generally parallel to the plane or surface of the floor of the area in which the device being described is used or the method being described is performed, regardless of its orientation. The term "floor" can be interchanged with the term "ground." The term "vertical" refers to a direction perpendicular to the lateral as just defined.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments.

The terms "approximately," "about," and "substantially" as used herein represent an amount close to the stated amount that still performs a desired function or achieves a desired result. For example, in some embodiments, as the context may dictate, the terms "approximately", "about", and "substantially" may refer to an amount that is within less than or equal to 10% of the stated amount. The term "generally" as used herein represents a value, amount, or characteristic that predominantly includes or tends toward a particular value, amount, or characteristic. As an example, in certain embodiments, as the context may dictate, the term "generally parallel" can refer to something that departs from exactly parallel by less than or equal to 20 degrees.

Some embodiments have been described in connection with the accompanying drawings. The figures are drawn to scale, but such scale should not be limiting, since dimensions and proportions other than what are shown are contemplated and are within the scope of the disclosed invention. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Additionally, it will be recognized that any methods described herein may be practiced using any device suitable for performing the recited steps.

For purposes of this disclosure, certain aspects, advantages, and novel features are described herein. It is to be understood that not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Moreover, while illustrative embodiments have been described herein, the scope of any and all embodiments having equivalent elements, modifications, omissions, combinations (e.g., of aspects across various embodiments), adaptations and/or alterations as would be appreciated by those in the art based on the present disclosure are part of this specification. The limitations in the claims are to be interpreted broadly based on the language employed in the claims and not limited to the examples described in the present specification or during the prosecution of the application, which examples are to be construed as non-exclusive. The specification and examples should be considered as illustrative only, with a true scope and spirit being indicated by the claims and their full scope of equivalents.

The following is claimed:

1. A trash can assembly comprising:

a body having an interior space, a base portion, and an upper body portion;

a lid connected with the body and movable between an open position and a closed position;

a pedal pivotally mounted to the body so as to be moveable at least between resting and actuated positions, the resting position corresponding to the lid being in the closed position and the actuated position corresponding to the lid being in the open position;

a gear assembly mechanically connected with the pedal such that movement of the pedal between the resting position and the actuated position drives the gear assembly;

a lid position sensor configured to detect the position of the lid;

a controller configured to receive a signal from the lid position sensor indicative of the position of the lid; and an electric load control system mechanically connected to the gear assembly, the electric load control system configured to provide variable resistance against rotation of portions of the gear assembly, thereby providing variable resistance against movement of the pedal and the lid as the lid moves from the closed position to the open position and as the lid moves from the open position to the closed position.

2. The trash can according to claim 1, wherein the electric load control system provides a first dampening response over a first range of motion of the lid from the open position toward the closed position and provides a second dampening response over a second range of motion of the lid from the closed position toward the open position, the second range of motion being smaller than the first range of motion.

3. The trash can according to claim 1, wherein the electric load control system is configured to provide a first dampening response against the motion of the lid from the open position toward the closed position and a second dampening response against the motion of the lid from the closed position toward the open position, the first dampening response being different from the second dampening response.

4. The trash can according to claim 1, additionally comprising at least one rod having first and second ends, the first end connected to the pedal and the second end connected to the lid such that the rod pushes the lid from the closed position to the open position as the pedal is moved from the resting position to the actuated position.

5. The trash can according to claim 1, wherein the electric load control system comprises a potentiometer.

6. The trash can according to claim 1, wherein the electric load control system is configured to provide variable resistance such that the speed of the lid is greater in an initial stage of movement than in an ending stage of movement.

7. The trash can according to claim 1, wherein the electric load control system is configured to provide variable resistance such that the lid slows before reaching the open position.

8. The trash can according to claim 1, further comprising an energy recapture system connected with the transfer assembly or the lid and configured to convert kinetic energy into electrical energy.

9. The trash can according to claim 8, further comprising an energy storage device configured to receive and store the electrical energy.

10. The trash can according to claim 8, wherein the energy recapture system comprises an electric generator and a gear train, the electric generator comprising a rotor and a stator, the gear train connected with the transfer assembly and the rotor such that movement of the transfer assembly is transferred to the rotor.

11. The trash can according to claim 1, further comprising an ion generation device that is configured to discharge ions into the interior space.

12. The trash can according to claim 10, wherein the ion generation device is fixedly coupled to the lid.

13. The trash can according to claim 1, wherein the controller is further configured to control, based at least partly on the position of the lid, the amount of resistance provided by the electric load control system.

14. The trash can according to claim 1, further comprising an electrical generator, wherein the transfer assembly is mechanically connected in parallel to the electrical generator and the lid.

15. The trash can according to claim 1, further comprising a trim ring that is configured to secure or retain an upper portion of a bag liner between the trim ring and an upper edge of the upper body portion.

16. The trash can according to claim 1, further comprising a linkage operatively connecting the lid, pedal, and gear assembly.

17. The trash can according to claim 16, wherein the linkage translates generally vertically as the pedal moves between the resting and actuated positions, and wherein the translation of the linkage rod is converted to rotational movement by a linear actuator.

18. The trash can according to claim 1, wherein the lid position sensor comprises an infrared sensor, proximity sensor, or ultrasonic sensor.

19. The trash can according to claim 1, wherein the variable resistance has an approximately parabolic or approximately exponential profile.

20. The trash can according to claim 1, wherein the variable resistance is such that the lid initially opens faster than the lid initially closes.

* * * * *